US007244021B2

(12) United States Patent
Arai

(10) Patent No.: US 7,244,021 B2
(45) Date of Patent: Jul. 17, 2007

(54) IMAGE RECORDING DEVICE

(75) Inventor: Takeo Arai, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 295 days.

(21) Appl. No.: 10/807,223

(22) Filed: Mar. 24, 2004

(65) Prior Publication Data

US 2004/0189772 A1 Sep. 30, 2004

(30) Foreign Application Priority Data

Mar. 27, 2003 (JP) ..... 2003-088685
Feb. 24, 2004 (JP) ..... 2004-047641

(51) Int. Cl.
*B41J 2/01* (2006.01)
*B41J 29/38* (2006.01)

(52) U.S. Cl. ..... 347/102; 347/101; 347/9

(58) Field of Classification Search ..... 347/102, 347/101, 5, 9; 101/488; 219/216; 399/320
See application file for complete search history.

(56) References Cited

U.S. PATENT DOCUMENTS 4,704,615 A * 11/1987 Tanaka ..... 347/212
6,084,609 A * 7/2000 Manini et al. ..... 347/40
6,145,979 A * 11/2000 Caiger et al. ..... 347/102
6,152,030 A * 11/2000 Fuqua ..... 101/115
6,248,804 B1 * 6/2001 Lutz ..... 523/160
6,344,819 B1 * 2/2002 Pond ..... 342/100
6,562,413 B1 * 5/2003 Morgavi ..... 427/466
6,834,948 B2 * 12/2004 Asano et al. ..... 347/102
7,014,310 B2 * 3/2006 Hirai ..... 347/102
7,134,749 B2 * 11/2006 Ben-Zur et al. ..... 347/101
2003/0035037 A1 * 2/2003 Mills et al. ..... 347/102
2003/0149130 A1 * 8/2003 Kondo ..... 523/160
2004/0041893 A1 * 3/2004 Hoshino ..... 347/102

FOREIGN PATENT DOCUMENTS

JP 2001-131452 11/1999
JP 2001-310454 11/2001

* cited by examiner

*Primary Examiner*—Stephen Meier
*Assistant Examiner*—Leonard Liang
(74) *Attorney, Agent, or Firm*—Finnegan, Henderson, Farabow, Garrett & Dunner, L.L.P.

(57) ABSTRACT

An image recording device has: a first recording head which discharges a first ink for a first image forming process; a second recording head which discharges a second ink for a second image forming process; a curing section which cures an ink on a recording medium; and a controller which controls the curing section to cure the first ink on the recording medium, and controls the second recording head to start discharging the second ink after a conversion of the first ink on the recording medium becomes not less than 30%.

25 Claims, 9 Drawing Sheets

IMAGE RECORDING DEVICE

BACKGROUND OF THE INVENTION

1. Field of the Invention

The invention relates to an image recording device, in particular, an image recording device adopting a line print system and forming an image on a recording medium with the use of an ink including a light curable component.

2. Description of Related Art

In general, as an image recording means capable of printing on various types of recording mediums, an image forming means with a gravure printing system and one with a flexographic printing system are known. These image forming means, which are to feed ink into a reentrant portion formed on a printing surface and to directly transfer it onto a recording medium, have characteristics such as capability of colorfully expressing letters, marks and graphics, capability of printing fast onto large amount of recording medium and the like. These days in particular, printing is performed on various packaging medium, and in such a case, it is effective to use the image forming means with the gravure printing system or the flexographic printing system. However, at a pre-step of actually performing the printing, these image forming means need to go through a prepress step for making a plate, and it is necessary to spend cost and time for the prepress step. Given this factor, in the case of performing small-amount but many-variety printing, it is desirable to have means to perform the printing without a plate in accordance with either a transparent or opaque packaging medium.

In view of this, as means capable of printing on various types of recording mediums, an image recording device with an inkjet system has been conventionally known. The image recording device with an inkjet system is to record an image on a recording medium by discharging an ink to be dropped and fixed on the recording medium, the ink discharged from nozzles provided on a plane of a recording head opposed to the recording medium, and the image recording device with an inkjet system has an advantage of being capable of printing according to demand because the prepress step is not necessary. However, in the case of using the inkjet image recording device in general, an ink easily gets blurred on a recording medium, and therefore it is only possible to perform the image recording on a recording medium with high ink absorbability. In particular, it is significantly difficult to perform the image recording on transparent resin film or the like, which does not have a specific image-reception layer provided therein.

On the contrary, as means capable of forming an image even on a recording medium with little ink absorbability such as a medium made of resin film, plastic or the like, these days, an inkjet image recording device with the use of ultraviolet-ray curable ink is known (for example, see Japanese Patent Application Publications Nos. Tokukai 2001-310454, and Tokukai 2001-131452). These devices have a structure where, with the use of ultraviolet-ray curable ink which contains photoinitiator having predetermined sensitivity with ultraviolet rays, by irradiating ultraviolet rays to an ink dropped on a recording medium, the ink gets cured and fixed on the recording medium. With these devices, it is possible to easily perform the printing on either a transparent or semi-transparent (translucent) packaging medium.

In addition, if the printing to be performed on a transparent or semi-transparent packaging medium or the like, there are cases of performing the printing over a printing surface on which an image recording has been performed for the purpose of maintaining durability against scratch. This is called, "back printing". Further, if the printing is to be performed on a transparent or semi-transparent packaging medium, there are cases of performing the printing in advance on the entire surface of the packaging medium and then performing the image recording with an ink of each color over the recording medium for making the recorded image by the ink of each color stand out visually. This is called "front printing". For example, if it is necessary to print letters, marks, graphics or the like over a background color after a specific color such as white or the like is printed as the background against a transparent packaging medium, when the back printing is to be performed, an ink for a background such as white or the like may be printed, and when the front printing is to be performed, an ink for a background such as white or the like is printed firstly, and then an ink or each color may be printed. Further, in the case of performing the printing on a transparent or semi-transparent packaging medium or the like, as means with which it is possible to obtain substantially the same effect as the "front printing", by which it is possible to make a recorded image by color inks of each color stand out, a duplex printing by which printing is performed with an ink for a background over the entire recording medium, and then printing is performed with an ink of each color on the opposite side of the recording medium is available.

In this aspect, as such an inkjet image recording device performing the printing on a transparent or semi-transparent packaging medium with the use of an ink for a background, an image recording device with a serial print system which performs image recording by moving a recording head in a main scanning direction back and forth, may be used.

However, in order to print the ink for a background such as white or the like as a background by the image recording device with the serial print system, it is necessary to additionally have a recording head of the ink for a background color on a carriage, the recording head being located apart from a recording head for a color purpose, and thereby it makes the carriage larger, which makes the entire image recording device larger correspondingly, and further it makes the device structure complicated. For example, in particular, in a case of mounting the recording head which discharges the ink for a background and the other recording head on the same carriage, weight of the carriage increases, and thereby it is difficult to maintain scanning speed and dropping accuracy which could be achieved in the case without having the recording head of the ink for a background.

SUMMARY OF THE INVENTION

The present invention is made so as to solve the above-mentioned problem. An object of the present invention is to provide an image recording device capable of effectively performing front printing, back printing and duplex printing on a transparent or semi-transparent recording medium with high resolution maintained.

In accordance with a first aspect of the present invention, an image recording device, comprises: a first recording head which discharges a first ink for a first image forming process; a second recording head which discharges a second ink for a second image forming process; a curing section which cures an ink on a recording medium; and a controller which controls the curing section to cure the first ink on the recording medium, and controls the second recording head to start discharging the second ink after a conversion of the first ink on the recording medium becomes not less than 30%.

Preferably, in the device of the first aspect of the present invention, the controller controls at least one of the first recording head and the second recording head so as to overlap at least a part of a first recording area of the first image forming process and a part of a second recording area of the second image forming process in an arbitrary area on a recording surface of the recording medium.

Preferably, in the device of the first aspect of the present invention, a color of the first ink or the second ink is white.

Preferably, in the device of the first aspect of the present invention, one of the first image forming process and the second image forming process is a process for an image, the other is a process for a background.

Preferably, in the device of the first aspect of the present invention, the controller controls either the first recording head or the second recording head so as to record in all of an arbitrary area of the recording medium.

Preferably, in the device of the first aspect of the present invention, the first recording head and the second recording head include a plurality of nozzles for an ink discharge, and a diameter of ink at the 100% conversion of the ink is not less than 140% of a distance between centers of adjacent nozzles of the first recording head or the second recording head.

Preferably, the device of the first aspect of the present invention further comprises: a third recording head which discharges a third ink for either the first image forming process or the second image forming process; a fourth recording head which discharges a fourth ink for same process of the third recording head; and a fifth recording head which discharges a fifth ink for same process of the third recording head.

More preferably, in the above-mentioned device, the curing section includes a plurality of cure devices corresponding to each recording heads.

Preferably, in the device of the first aspect of the present invention, the curing section cures the first ink and the second ink on the recording medium.

Preferably, in the device of the first aspect of the present invention, the curing section includes a first cure device for the first image forming process and a second cure device for the second image forming process.

Preferably, in the device of the first aspect of the present invention, the first recording head and the second recording head are extending in a width direction of the recording medium.

Preferably, in the device of the first aspect of the present invention, each of the first and second ink is an ultraviolet-ray curable ink, which is cured as irradiated with ultraviolet rays, and the curing section includes an ultraviolet light source which generates ultraviolet rays to cure the ultraviolet-ray curable ink.

Preferably, the device of the first aspect of the present invention further comprises: a moving section which relatively moves the recording medium to the first and second recording head and/or the curing section.

In accordance with a second aspect of the present invention, an image recording device, comprises: a first recording head which discharges a first ink for an image recording to a first surface of a recording medium; a first curing section which cures the first ink on the first surface of the recording medium; a second recording head which discharges a second ink for a background recording to a second surface of the recording medium, the second surface is opposite side of the first surface; and a second curing section which cures the second ink on the second surface of the recording medium.

Preferably, in the device of the second aspect of the present invention, the recording medium is a transparent material or a semi-transparent material.

Preferably, in the device of the second aspect of the present invention, a color of the first ink or the second ink is white.

Preferably, in the device of the second aspect of the present invention, one of the first image forming process and the second image forming process is a process for an image, the other is a process for a background.

Preferably, in the device of the second aspect of the present invention, the controller controls either the first recording head or the second recording head so as to record in all of an arbitrary area of the recording medium.

Preferably, in the device of the second aspect of the present invention, the first recording head and the second recording head include a plurality of nozzles for an ink discharge, and a diameter of ink at the 100% conversion of the ink is not less than 140% of a distance between centers of adjacent nozzles of the first recording head or the second recording head.

Preferably, in the device of the second aspect of the present invention, the first recording head and the second recording head are extending in a width direction of the recording medium.

Preferably, in the device of the second aspect of the present invention, each of the first and second ink is an ultraviolet-ray curable ink, which is cured as irradiated with ultraviolet rays, and the curing section includes an ultraviolet light source which generates ultraviolet rays to cure the ultraviolet-ray curable ink.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

EMBODIMENTS OF THE INVENTION

Hereinafter, a first embodiment of an image recording device will be described with reference to figures. Here, the description is not made to limit the scope of the claims or the meanings of words.

Figure 1:
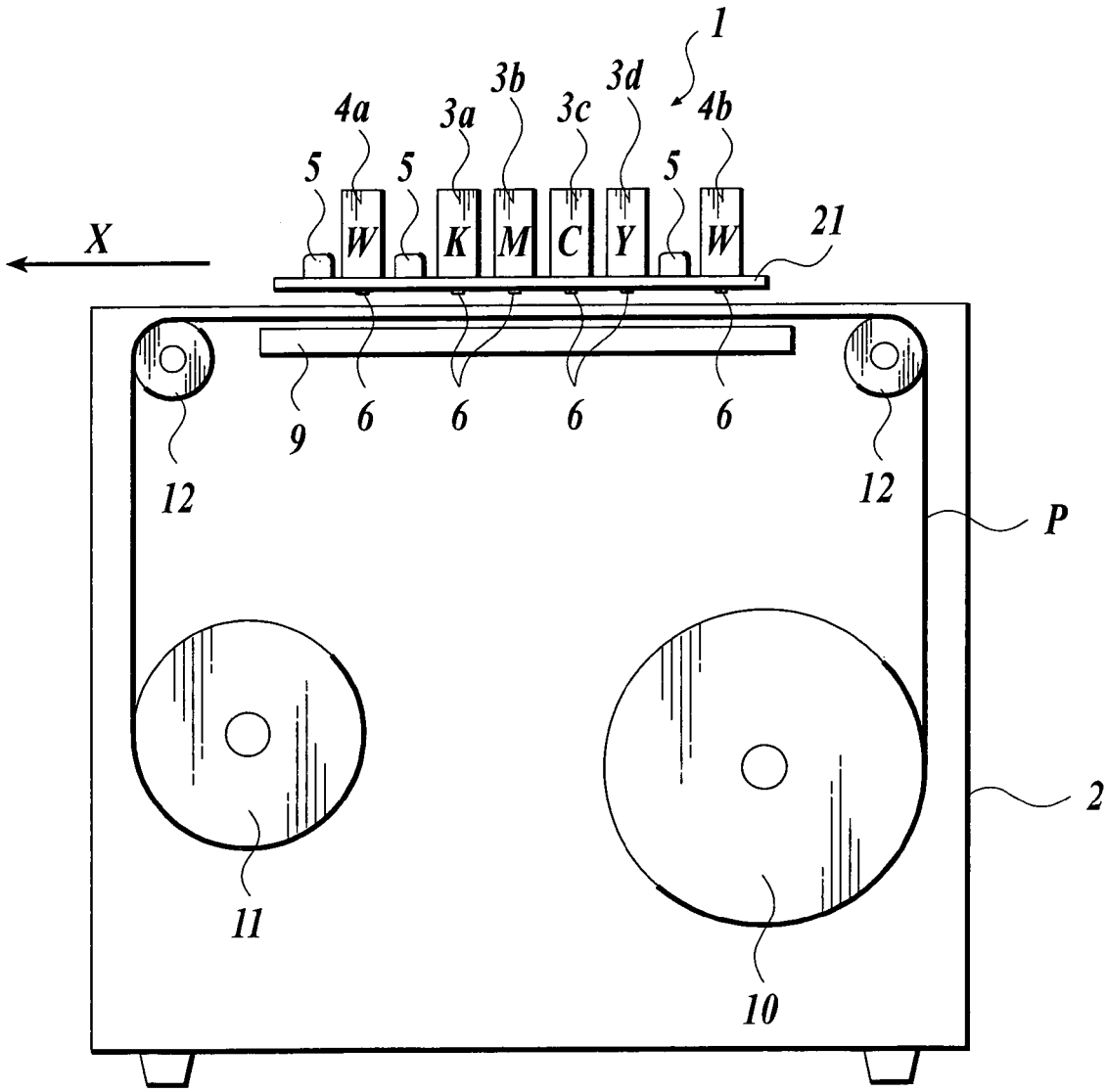
FIG. 1 is a front view showing a frame format of an image recording device in the first embodiment according to the present invention.

First, as shown in FIG. 1, in the present embodiment, an image recording device 1 which adopts a line print system, comprises a device body 2 formed as a cuboid.

Approximately at a center part on upper surface of the device body 2, a platen 9 for supporting a recording medium P from its non-recording surface is located approximately horizontally along the upper surface of the device body 2. At an upstream side in a conveyance direction X of the recording medium P with respect to the platen 9, a feeding roller 10 into which the long-sheet recording medium P having predetermined width is wound is placed rotatably, and at a downstream side in the conveyance direction X with respect to the platen 9, a winding roller 11 for winding the recording medium P fed from the feeding roller 10 is placed.

Further, between the feeding roller 10 and the platen 9 and between the platen 9 and the winding roller 11 respectively, placed are guide rollers 12 rotatably for guiding the recording medium P fed from the feeding roller 10 with predetermined tension added.

The winding roller 11 is rotatable by a roller driving mechanism 20 (see FIG. 3), and the recording medium P is, due to rotation of the winding roller 11 by the roller driving mechanism 20, guided by the guide rollers 12, conveyed along the upper surface of the platen 9 in the conveyance direction X with approximately the same height maintained as the platen 9, and wound into the winding roller 11.

Figure 2:
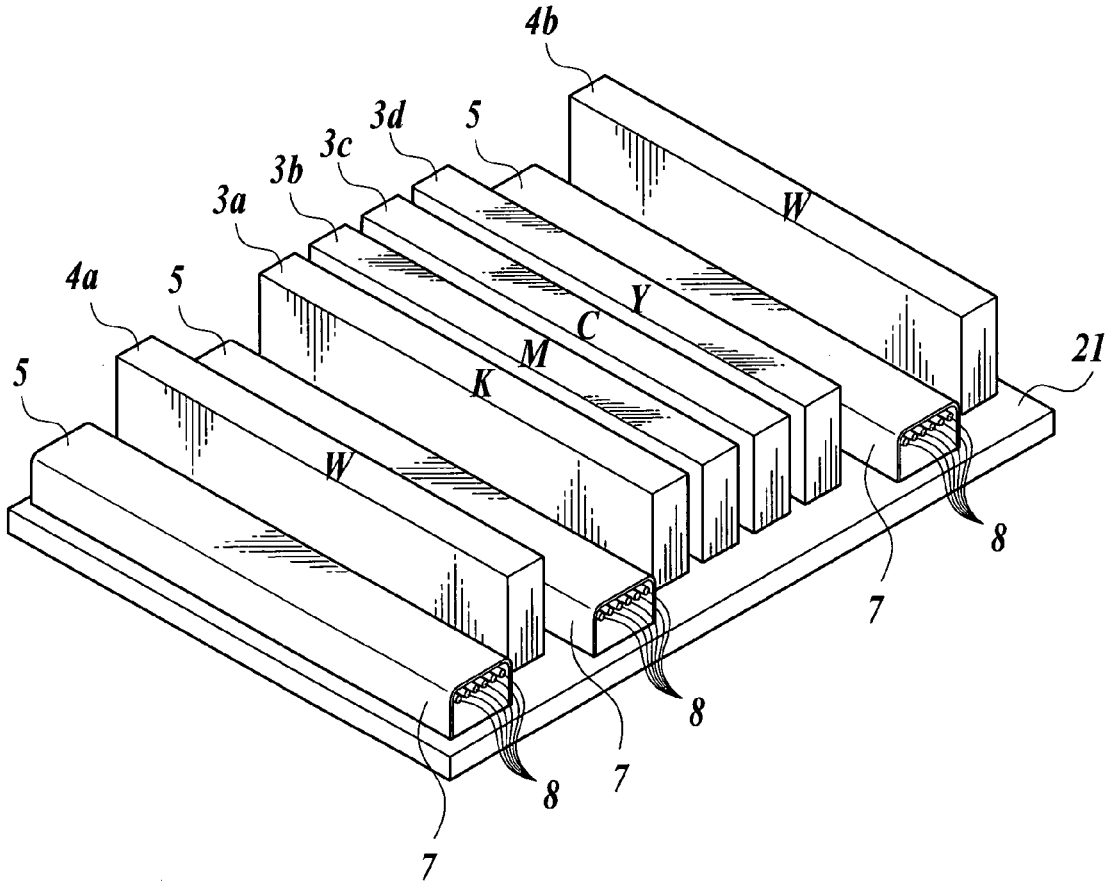
FIG. 2 is a perspective view showing an arrangement of recording heads and ultraviolet rays of the image recording device according to the present invention.

Above the platen 9, as shown in FIG. 1 and FIG. 2, a plurality of color recording heads corresponding to each color to be used in the image recording device 1 in the present embodiment are arranged in a width direction of the recording medium P, with a predetermined interval secured between so as to make longitudinal directions thereof in parallel with each other.

The recording heads include a first recording head for discharging a first ink which is used in a first image forming process, and a second recording head for discharging a second ink which is used in a second image forming process. For example, if the second image forming process is color image recording with the use of each color, provided are the second recording heads corresponding to four colors (Black (K), Magenta (M), Cyan (C) and Yellow (Y)) as the second ink used in the image recording device 1 in the present embodiment. In other words, a second recording head 3*a* for discharging black (K) as a second ink, a third recording head 3*b* for discharging magenta (M) as a third ink, a fourth recording head 3*c* for discharging cyan (C) as a fourth ink and a fifth recording head 3*d* for discharging yellow (Y) as a fifth ink are arranged respectively in the width direction of the recording medium P with a predetermined interval secured between so as to make longitudinal directions thereof in parallel with each other. Each of the color recording heads 3*a*, 3*b*, 3*c* and 3*d* has a contour of approximately a cuboid shape, and they are arranged approximately at the center on a supporting member 21 as a group. Here, the arrangement order of the color recording heads 3*a*, 3*b*, 3*c* and 3*d* is not limited to the mentioned order. Further, a color of the ink used in the image recording device 1 is not limited to the above-mentioned color. For example, colors such as light yellow (LY), light magenta (LM), light cyan (LC) or the like may be used instead. Further, for the purpose of drawing images or letters, white may be used. In this case, color recording heads corresponding to each of the colors are placed on the supporting member 21.

Further, on the supporting member 21, at a downstream side and an upstream side in the conveyance direction X of the recording medium P with respect to a group of the color recording heads 3*a*, 3*b*, 3*c* and 3*d*, background recording heads 4*a* and 4*b* as the first recording head for discharging a white (W) ink for a background as the first ink to be used in the first image forming process are arranged. The background recording heads 4*a* and 4*b* have a contour of approximately a cuboid shape, and are arranged in the width direction of the recording medium P so as to make longitudinal directions thereof in parallel with that of the color recording heads 3*a*, 3*b*, 3*c* and 3*d*.

Here, an ink for a background has to be capable of making letters and images to be printed stand out. In addition, preferably, a white ink layer having transmission density not less than 0.15 or an L value not less than 65 is used in order to obtain favorable color expression characteristic and gradation characteristic of suitable color images. More preferably, the transmission density is not less than 0.2 or the L value is not less than 70. In the case of using lower value or having no white ink layer, it is not possible to have contrast between a recording medium to be printed and a color image, and thereby visibility decreases and especially image quality deterioration occurs in a low density area due to insufficient gradation characteristic. Although there is no specific upper limit, at a level to be acknowledged as high density in view of ink production, preferably the transmission density is not more than 0.5, or the L value is not more than 100.

Here, the transmission density in the present embodiment means transmission density measured with optical transmission densitometer represented by Macbeth densitometer or X-RITE densitometer, and normally, measurement is performed through each filter such as red, blue, green or the like depending on a color to be measured, but here, it means transmission density measured through a blue filter with which transmission density of white system can be efficiently measured. Further, the L value in the present embodiment is a brightness index L* indicated according to JIS Z 8729, and for example, it is measured with the use of Gretag Macbeth or Spectrolino. The closer to 100 the L value becomes, its brightness gets higher (whiter), and the closer to 0 the L value becomes, its brightness gets lower (blacker).

Further, the white ink in the present embodiment means a hypochromic ink used as the ink for a background, and under measurement by Minolta color measuring machine, CM2002 measurement mode D50 2 degree viewing field, SCF mode, white background (color of paper underlying the paper to be measured), a color within a hue range expressed by a position in Lab color space is on or within 20 in radius in the a*b* plane, and L* is not less than 70. Accordingly, it is not limited to pure white, but includes dilute gray, cream-like color and the like.

Here, in the present embodiment, a white ink is used as the ink for a background, but the ink for a background is not limited to a white ink as long as the ink is capable of making printing letters or images stand out.

Further, in the present embodiment, as long as a background ink is capable of making the printing letters and images stand out, it is not necessary to perform the image recording over the whole recording medium P, and therefore it is only necessary to perform the image recording over the whole of an arbitrary area with the background ink. Further, within the scope of the above-mentioned operation and effect, it is also possible to apply the background ink to applications such as bordering around letters or images, ornamenting and the like.

On a surface opposed to the recording medium P, the surface opposite to where each of the color recording heads 3*a*, 3*b*, 3*c* and 3*d* and the background recording heads 4*a* and 4*b* is located, a plurality of nozzles 6, 6 . . . for discharging an ultraviolet-ray curable ink to the recording medium P are arranged so as to be in parallel with the longitudinal direction of each of the color recording heads 3*a*, 3*b*, 3*c* and 3*d* and the background recording heads 4*a* and 4*b*.

Further, at a downstream side in the conveyance direction X with respect to the background recording head 4*a* located at a downstream side in the conveyance direction X of the recording medium P, and at a space between the background recording head 4*a* and a group of the color recording heads 3*a*, 3*b*, 3*c* and 3*b*, and at a space between the group of the color recording heads 3*a*, 3*b*, 3*c* and 3*b* and the background recording head 4*b*, respectively one ultraviolet irradiating device 5 as an ink curing section is arranged approximately in parallel with the color recording heads 3*a*, 3*b*, 3*c* and 3*d*, and the background recording heads 4*a* and 4*b*. The ultraviolet irradiation devices 5, 5 have a longer size than the longitudinal length of the recording heads 3 and 4. The ultraviolet irradiation devices 5, 5 comprise a cover member 7 formed as a box-like shape having openings at one end, and the cover member 7 is arranged so as to have the opening thereof opposed to the recording surface of the recording medium P. Further, on an upper surface of the cover member 7, the surface formed as approximately parallel to the recording surface of the recording medium P, arranged are a plurality of bar-like ultraviolet light sources 8, 8 . . . for irradiating ultraviolet rays to cure and fix an ultraviolet-ray curable ink dropped on the recording medium P so as to make longitudinal directions thereof in parallel with each other. Here, as the ultraviolet light sources 8, 8 . . . a high-pressure mercury lamp, a metal halide lamp, a hot cathode tube, a cold cathode tube, an LED or the like may be used.

Here, the ink used in the present embodiment will be described.

The ink used in the present embodiment is an ultraviolet-ray curable type ink, which is cured by getting ultraviolet rays irradiated to. As a component of this ultraviolet-ray curable type ink for an inkjet purpose, for example, known is a photo polymerization ink component with the use of radical polymerization compound having ethylene unsaturated bond capable of radical polymerization, and light curable resin of the cation polymerization system such as a compound written in Japanese Patent Application Publication (Unexamined) No. Tokukai-Hei 7-159983, Japanese Patent Application Publication (Examined) No. Tokuko-Hei 7-31399, Japanese Patent Application Publication (Unexamined) No. Tokukai-Hei 8-224982, Japanese Patent Application Publication (Unexamined) No. Tokukai-Hei 10-863, Japanese Patent Application No. Tokugan-Hei 7-231444 or the like. In the present embodiment, an ink of either the radical polymerization system or the cation polymerization system can be used. However, especially preferably in the present embodiment, an ink component with the use of light curable resin of light cation polymerization type written in Japanese Patent Application Publication (Unexamined) No. Tokukai-Hei 6-43633, Japanese Patent Application Publication (Unexamined) No. Tokukai-Hei 8-32413 or the like is used. Further, in addition, in the present embodiment, monomer written in Japanese Patent Application Publication (Unexamined) No. Tokukai 2002-288025, Japanese Patent Application Publication (Unexamined) No. Tokukai 2003-317139, Japanese Patent Application No. Tokugan 2003-8110, Japanese Patent Application Publication (Unexamined) No. Tokukai 2002-187918, Journal of the Japan Society of Color Material 75(8), 394(2002) "View of Ultraviolet Curing Technology for Inkjet Printing" or the like may be used. In addition, as these various types of monomer, color material, disclosure in WO99.29787, Japanese Patent Application Publication (Unexamined) No. Tokukai 2001-220526 or the like may be used, and so forth, initiator, addition agent and the like may be referred to these documents.

Figure 3:
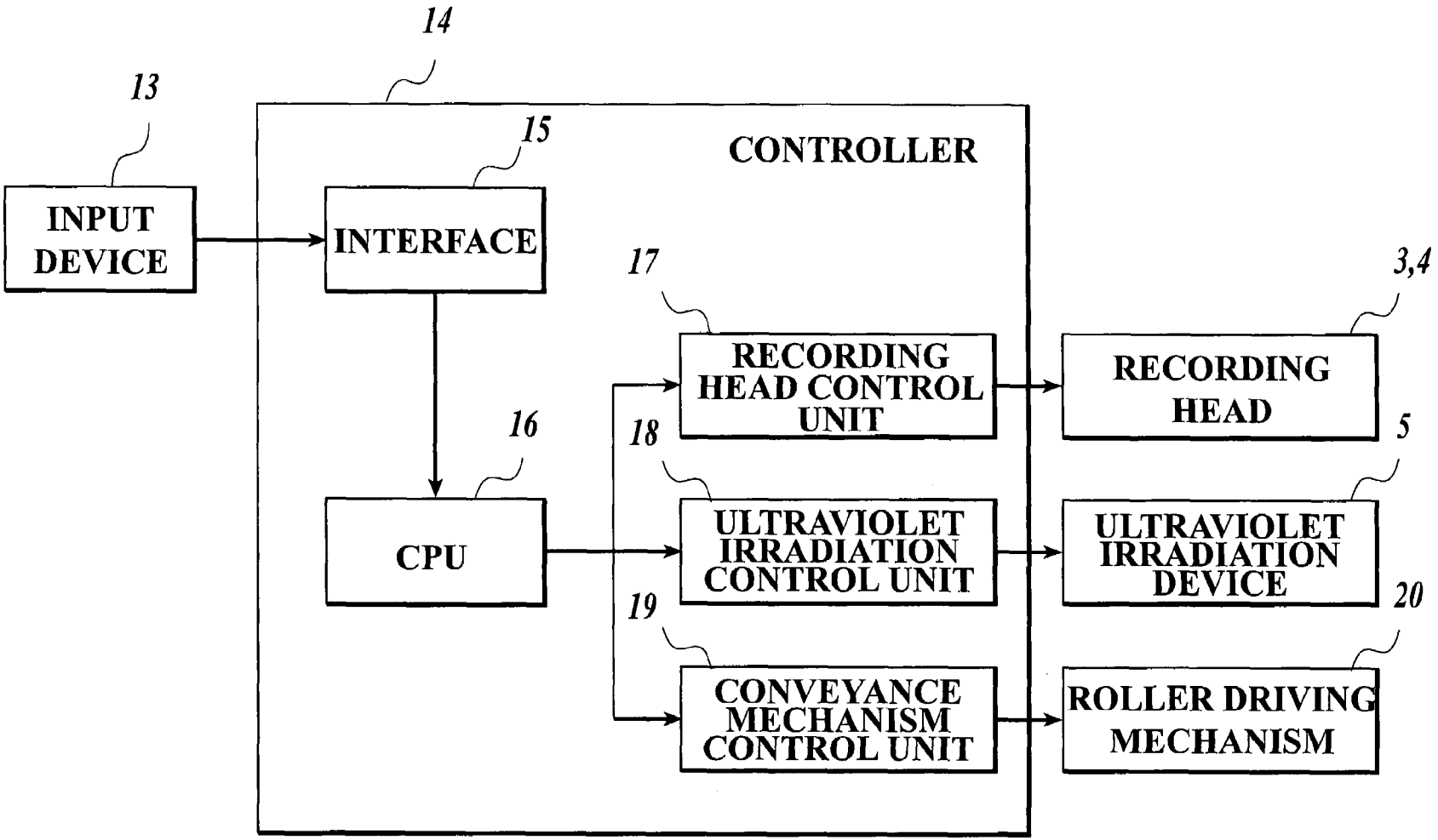
FIG. 3 is a block diagram showing substantial parts of a controller according to the present embodiment.

Next, with reference to FIG. 3, a controller in the present embodiment will be described.

The image recording device 1 in the present embodiment comprises an input device 13 for selecting a printing type and inputting image data. The input device 13 is connected a controller 14 which controls each part of the image recording device 1 through an interface 15, and information inputted from the input device 13 is transmitted as an electrical signal to a CPU 16 which controls driving of each part. The input device 13 is, for example, a keyboard or an operation panel, and with the input device 13, it is possible to select a printing mode such as a front printing mode, a back printing mode and the like.

The controller judges whether to firstly perform between the first image forming process to make the background recording heads 4*a* and 4*b* as the first recording head discharge the background white ink (W) as the first ink, and the second image forming process to make the color recoding heads 3*a*, 3*b*, 3*c* and 3*d* as the second recording head discharge color ink as the second to fifth ink, or the like.

Here, a structure for selecting a printing type or inputting image data is not limited to the mentioned example. For example, it is possible to form an input device from a device such as a personal computer, and to connect the input device externally to the image formation device.

When the CPU 16 receives a signal from the input device 13, the CPU 16 transmits the signal to each of a recording head control unit 17, an ultraviolet irradiation control unit 18 and conveyance mechanism control unit 19.

In response to the signal from the CPU, the recording head control unit 17 makes predetermined recording heads 3 and 4 serve for discharging ink. Here, ink amount discharged from the nozzles 6, 6 . . . placed on the background recording head 4 is controlled so as to make a droplet size (dot diameter) of an ink discharged and dropped from the nozzles 6, 6 . . . not less than 140% of the nozzle interval with a conversion ratio of the dropped ink 100%. Here, the conversion will be described later. It is necessary to discharge a white ink to be printed on the recording medium P as a background evenly over the recording medium P without any unevenness and to enhance shielding characteristic of the background printing so as to make letters or the like clear when the letters, images or the like are printed. This is because, as shown in TABLE 1, it is possible to obtain sufficient shielding characteristic when a droplet size of an ink with respect to the distance between the centers of the adjacent nozzles of background recording heads 4 and 4 is not less than 140%.

In view of this, in a serial-type image formation device forming an image by driving a carriage or the like, it is possible to perform the recording a plurality of times by moving the same color head back and forth over any identical area in a main scanning direction, and thereby it is possible to obtain sufficient shielding characteristic. However, in the line print system in the present embodiment, since the back-and-forth movement in the main scanning direction does not exist, in the case of applications such as recording an image for a background in particular, it is significantly important to define a size of such ink.

TABLE 1

Legibility of letters on a letter document when a transparent recording medium with a background printing performed with white ink is put on the letter document

| DOT DIAMETER/ NOZZLE INTERVAL | SHIELDING CHARACTERISTIC |
|---|---|
| 100% | A |
| 120% | B |
| 140% | C |
| 160% | D |
| 200% | D |

A: Letters on the document are sufficiently readable
B: Letters are readable with difficulty
C: Letters are recognizable but hardly readable
D: Letters are not recognizable Further, the ultraviolet irradiation control unit 18, in response to a signal from the CPU, switches the ultraviolet irradiation device 5 which serves according to a printing type corresponding to the transmitted signal.

Further, when the conveyance mechanism control unit 19 receives a signal from the CPU, the conveyance mechanism control unit 19 conveys the recording medium P in the conveyance direction X by controlling a roller driving mechanism 20 so as to rotate the winding roller 11.

Here, there is a possibility that, when a color ink and a background ink gets in contact with each other on the recording medium without sufficiently being cured, the two types of inks get mixed and blurring or the like occurs. Given this factor, preferably, regarding the color ink and the background ink, after an ink discharged firstly on the recording medium and gets cured sufficiently so as not to be mixed with the ink to be discharged secondly, then the ink is discharged secondly. Therefore, it is necessary that, after either one of the color ink or the background ink is discharged firstly, ultraviolet rays irradiation by the ultraviolet irradiation device is performed until the other ink is discharged so as to cure the ink without the blurring of the ink occurring.

In this point, whether the ink is in a state of being cured sufficiently so as not to make the blurring occur, can be recognized by measuring a conversion. The conversion indicates a ratio of polymerization degree where the polymerization degree of the state that the ink system is completely cured is defined as 100, and for example, it is possible to obtain the ratio by analyzing infrared spectrograph. In other words, in regard to a specific peak which varies according to polymerization reaction, by measuring a difference of light absorbance (maximum variation amount) between the point where a static state is achieved by adding sufficient energy for sufficient time and an unreacting state, it is calculated as a ratio of variation amount of light absorbance at a point with respect to the maximum variation amount. The conversion can be obtained, for example, with the use of an infrared spectroscopy photometer capable of measuring real-time such as NEXUS470 made by Thermo Nicolet or the like, by measuring secular change after predetermined light amount is added. Then, in order not to make the blurring of an ink occur, preferably the conversion is not less than 30%, in particular, not less than 50%. Therefore, in the present embodiment, since the recording head control unit 17 makes one of a white ink for a background or an ink of each color discharged until the other ink is discharged, the ultraviolet irradiation control unit makes the ultraviolet irradiation device serve to irradiate ultraviolet rays so as to make the conversion of the prior discharged ink not less than 50%. Here, the completely cured ink means, for example, an ink in a state where the change of light absorbance from at a point to at 10 seconds thereafter is within 0.1, or the like.

Figure 4A:
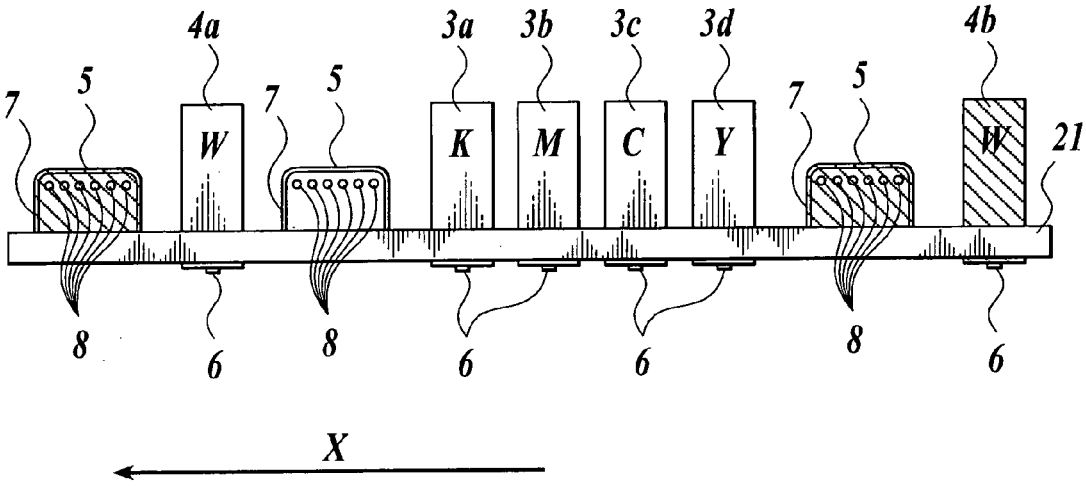
FIGS. 4A and 4B are pattern diagrams showing driving states of the ultraviolet irradiation devices and the background recording heads under each printing mode of the image recording device in the first embodiment according to the present invention.

Next, with reference to FIGS. 4A and 4B, operation of the present embodiment will be described.

When a printing mode is selected at the input device 13, this information is transmitted as an electronic signal to the CPU 16 in the controller 14 through the interface 15. In response to this signal, the CPU 16 transmits a signal such as a printing condition or the like to the ultraviolet irradiation control unit 18 and the recording head control unit 17. Based on this signal, the ultraviolet irradiation control unit 18 turns on the ultraviolet light sources 8, 8 . . . of the ultraviolet irradiation devices 5, 5 . . . corresponding to the selected printing mode. Further, by making the conveyance mechanism control unit 19 control the roller driving mechanism 20, the CPU 16 rotates the winding roller 11 and thereby the recording medium P is sequentially conveyed from upstream to downstream in the conveyance direction X with being held on the platen 9. At this time, among the recording heads 3 and 4, the color recording heads 3*a*, 3*b*, 3*c*, 3*d*, background recording heads 4*a* and/or 4*b* corresponding to the selected printing condition discharge an ink to the recording medium P. Then, the ultraviolet light sources 8, 8 . . . irradiate ultraviolet rays to the ink dropped on the recording medium P to record an image.

For example, when a front printing mode is selected at the input device 13, this information is transmitted to the CPU 16 in the controller 14, and further transmitted to the ultraviolet irradiation control unit 18 and the recording head control unit 17. As a result, the ultraviolet irradiation control unit 18 transmits a signal to the ultraviolet irradiation device 5, as shown with diagonal lines in FIG. 4A, among the ultraviolet irradiation devices 5 placed on the supporting member 21, ones located at an upstream side in the conveyance direction X of the recording medium P with respect to the color recording heads 3*a*, 3*b*, 3*c* and 3*d*, and the ultraviolet light sources 8, 8 . . . placed on the ultraviolet irradiation device 5 located at the furthermost downstream in the conveyance direction X are turned on. Further, the CPU transmits a signal indicating the start of image recording operation to the conveyance mechanism control unit 19. The conveyance mechanism control unit 19 having received the signal controls the roller driving mechanism 20 so as to rotate the winding roller 11, and with the guide roller 12 rotating in conjunction with the rotation of the winding roller 11, the recording medium P is conveyed from upstream to downstream in the conveyance direction X. Then, first, as shown with the diagonal lines in FIG. 4A, as the first image forming process, the nozzles 6, 6 . . . of the background recording head 4*b* located at an upstream side in the conveyance direction X of the recording medium P discharges a white ink as the first ink, and the ultraviolet light sources 8, 8 . . . in the ultraviolet irradiation device 5 located at a downstream side in the conveyance direction X with respect to the background recording head 4*b* irradiate ultraviolet rays to the ink dropped on the recording medium P for curing and fixing the white ink so as to make the conversion of the ink not less than 50%. Thereafter, as the second image forming process, the color recording heads 3*a*, 3*b*, 3*d* and 3*d* discharge an ink of predetermined colors as the second ink based on predetermined printing information, and the ultraviolet light sources 8, 8 . . . of the ultraviolet irradiation device 5 located at the furthermost downstream in the conveyance direction X of the recording medium P irradiate ultraviolet rays to the recording medium P. Thereby, each ink dropped on the recording medium is completely cured and fixed.

Figure 4B:
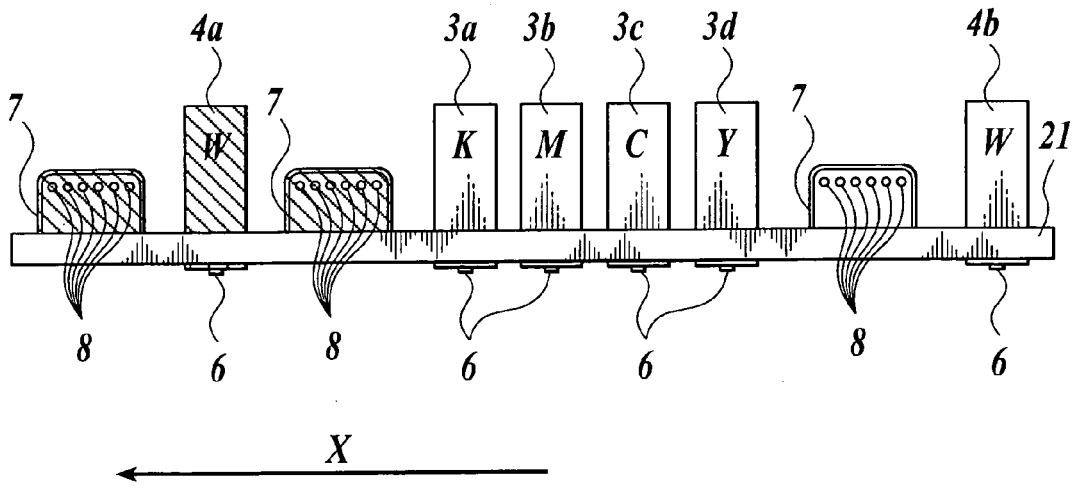

Further, when a back printing mode is selected, as shown in FIG. 4B, the ultraviolet sources 8, 8 . . . of the ultraviolet irradiation device 5 located at a downstream side in the conveyance direction X with respect to the color recording heads 3*a*, 3*b*, 3*c* and 3*d*, and the ones of the ultraviolet irradiation device 5 located at the furthermost downstream are turned on. Then, as the second image forming process, the color recording heads 3*a*, 3*b*, 3*c* and 3*d* discharges the ink of the predetermined colors as the second ink based on predetermined printing information, and the ultraviolet light sources 8, 8 . . . placed on the ultraviolet irradiation device 5 located next to the color recording heads 3*a*, 3*b*, 3*c* and 3*d* and located at a downstream side in the conveyance direction X with respect to irradiate ultraviolet rays to the ink dropped on the recording medium P for curing and fixing the color ink so as to make the conversion of the ink not less than 50%. Thereafter, as the first image forming process, the background recording head 4*a* as shown with diagonal lines in FIG. 4B discharges a white ink as the first ink, and the ultraviolet light sources 8, 8 . . . placed on the ultraviolet irradiation device 5 located at a downstream side in the conveyance direction X with respect to the background recording head 4*a* irradiates ultraviolet rays. Thereby, the white ink is cured and fixed.

As mentioned, by differentiating the timings of discharging an ink by the background recording heads 4*a* and 4*b* and the color recording heads 3*a*, 3*b*, 3*c* and 3*d*, after either a white or color ink is discharged and before the other ink is discharged, ultraviolet rays are irradiated to the ink. Thereby, curing and fixing are executed without mixing a white ink and a color ink. Consequently, it is possible to perform front printing and back printing with high definition achieved.

In the above-mentioned embodiment, since the background recording heads 4*a* and 4*b* are placed at both the furthermost upstream and the furthermost downstream in the recording medium conveyance direction, it is possible to perform both front printing and back printing by one image recording device.

Further, since amount of the ink discharged from the background recording head is made larger than that of the ink discharged from the color recording heads 3*a*, 3*b*, 3*c* and 3*d*, it is possible to form an image with high definition achieved by dropping small-droplet ink on the recording medium in the case of printing letters, images or the like with a color ink, and further it is possible to perform a background printing rapidly with high shielding characteristic. Thereby, it is possible to perform front printing and back printing efficiently.

Here, in the present embodiment, shielding characteristic of a background printing is enhanced by controlling amount of an ink discharged from the background recording heads 4*a* and 4*b* so as to make a droplet size (dot diameter) of the ink discharged and dropped from the nozzles 6, 6 . . . of the background recording heads 4*a* and 4*b* not less than 140% with respect to the nozzle interval. However, the present invention is not limited to the description above as long as it is possible to enhance the shielding characteristic of the background printing. For example, a nozzle diameter of the nozzles 6, 6 . . . placed on the background recording heads 4, 4 . . . may be made larger than the nozzles 6, 6 . . . placed on the color recording heads 3*a*, 3*b*, 3*c* and 3*d*, or a plurality of sets of the background recording heads 4*a* and 4*b* may be provided respectively at an upstream side and a downstream side in the conveyance direction X with respect to the color recording heads 3*a*, 3*b*, 3*c* and 3*d*.

Further, in the present embodiment, in the image recording device 1, the background recording heads 4*a* and 4*b* and the ultraviolet irradiation devices 5, 5 . . . are placed respectively at the upstream side and the downstream side in the conveyance direction X with respect to the color recording heads 3*a*, 3*b*, 3*c* and 3*d* so as to support both the printing modes, which are a front printing mode and a back printing mode. However, as a printer's specification, for example, the image recording device 1 may be limited to performing front printing, or may be limited to performing back printing. In this case, for example, if it is limited to performing front printing, it is not necessary to place the ultraviolet irradiation device 5 and the background recording head 4*a* each located next to the color recording heads 3*a*, 3*b*, 3*c* and 3*d* and located at the downstream side in the conveyance direction X with respect to. Further, if it is limited to performing back printing, it is not necessary to place the ultraviolet irradiation device 5 and the background recording head 4*b* each located at the upstream side in the conveyance direction X with respect to the color recording heads 3*a*, 3*b*, 3*c* and 3*d*. Thereby, it is possible to simplify the device structure.

Here, as mentioned, the recording medium P is conveyed with respect to each of the recording heads 3*a*, 3*b*, 3*c*, 3*d*, 4*a* and 4*b* and ultraviolet irradiation devices 5, 5 . . . as ink curing sections. However, the present invention is not limited to the mentioned example, and it may be in any form, for example, the form in which there is a relative moving mechanism for relatively moving the recording medium P and each of the recording heads 3*a*, 3*b*, 3*c*, 3*d*, 4*a* and 4*b* or the ultraviolet irradiation devices 5, 5 . . . as ink curing sections, and the controller controls the relative moving mechanism.

In the present embodiment, illustrated is the example that the image recording device 1 comprises the color recording heads 3*a*, 3*b*, 3*c* and 3*d* for discharging inks of four colors of black (K), magenta (m), cyan (c) and yellow in order to perform the second image forming process, and the background recording heads 4*a* and 4*b* for discharging a white (W) ink in order to perform the first image forming process. However, an ink in order to perform the first image forming process is not limited to the above-mentioned combination. The image recording device 1 may comprises one recording head for discharging an ink of arbitrary one color.

Further, the ultraviolet irradiation device 5 as an ink curing section may be placed in correspondence with each of the color recording heads 3*a*, 3*b*, 3*c* and 3*d*. Or, the image recording device may comprise one ultraviolet irradiation device to be used in both the first image forming process and the second image forming process. In accordance with such a structure, it is possible to achieve the downsizing, weight saving and the like of the device.

Further, in the present embodiment, illustrated is the example that the ink discharged from the color recording heads 3*a*, 3*b*, 3*c* and 3*d* or the background recording heads 4*a* and 4*b* is directly dropped on the recording medium P. However, the present invention is not limited to the mentioned example. An ink discharged from the color recording heads 3*a*, 3*b*, 3*c* and 3*d* or the background recording heads 4*a* and 4*b* may be temporarily held in a carrying member such as an intermediate transferring member or the like, and thereafter the ink is transferred from the holding member to the recording medium P to drop the ink.

Further, in the present embodiment, after the firstly-discharged ink is cured so as to make the conversion of the ink not less than 50%, the other ink is discharged. However, the degree of curing ink is not limited to the description above as long as inks do not mix each other. For example, the curing may be performed so as to make the conversion of the ink not less than 30% or the like.

Here, in the present embodiment, the image recording is performed with the use of ink that is cured by irradiating ultraviolet rays. However, the ink is not limited to the description above. For example, the ink may be one that is cured by irradiating light, for example, electromagnetic wave other than ultraviolet rays such as electron rays, X-ray, visible light, infrared rays or the like. In this case, what is applied to the ink is, polymerized component which is cured by light other than ultraviolet rays, and photoinitiator which starts polymerization reaction between polymerized components by light other than ultraviolet rays. Further, in the case of using light-curable type ink which is cured by light other than ultraviolet rays, a light source irradiating such light is applied instead of ultraviolet light source.

Further, an ink which is cured without light irradiation may be applied. In this case, in order not to mix the firstly-discharged ink and the secondly-discharged ink, after one ink is discharged, the other ink is not discharged until necessary time has passed for a conversion of the ink to become not less than 50%.

Here, in the present embodiment, used as the recording medium P is a roll-type recording medium which is rolled by the feeding roller 10 and is wound by the winding roller 11. However, as a form of the recording medium P, other than the roll-type, it is possible to apply various types of forms such as cut-sheet type, plate type or the like. Further, as the recording medium P, other than various types of paper such as normal paper, recycled paper, glossy paper or the like, it is possible to apply recording medium made of various types of textile, various types of non-fabric textile, and further made of a material without ink absorption characteristic such as resin, metal, glass or the like, and the like.

Next, with reference to FIGS. 5A and 5B, a second embodiment of an image recording device according to the present invention will be described. Here, in the present embodiment, only arrangement of the recording heads and ultraviolet irradiation devices, control structures of conveyance mechanism of recording medium, discharging ink and the timing of ultraviolet rays irradiation will be described since the other structures are the same as the first embodiment. Hereinafter, in particular, what is different from the first embodiment will be described.

Figure 5A:
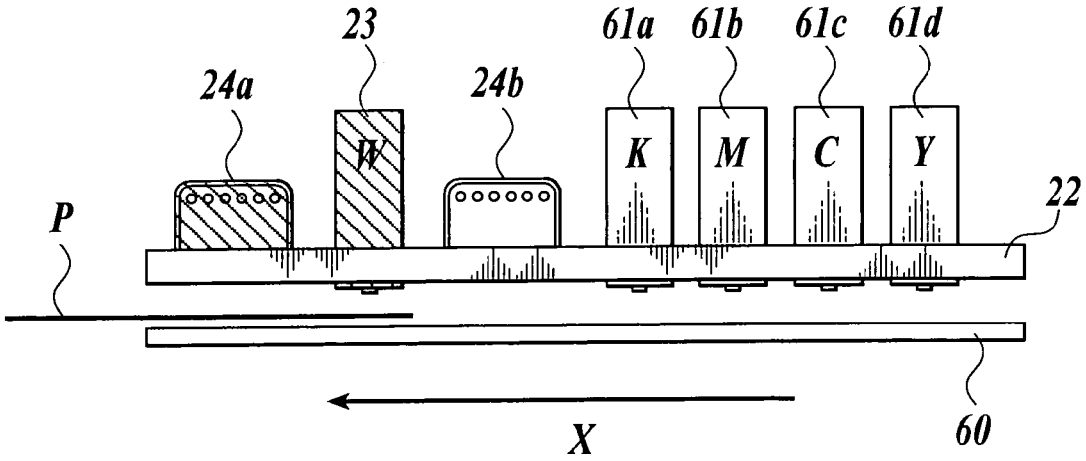
FIGS. 5A and 5B are pattern diagrams showing driving states of the ultraviolet irradiation devices and the background recording heads under each printing mode of the image recording device in the second embodiment according to the present invention.
Figure 5B:
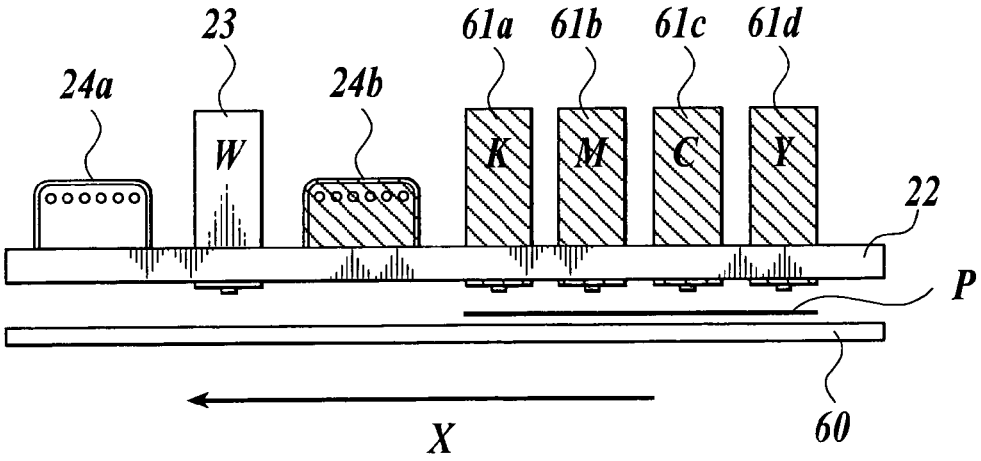

As shown in FIGS. 5A and 5B, in the present embodiment, above a platen 60, a second color recording head 61*a*, a third color recording head 61*b*, a fourth color recording head 61*c* and a fifth color recording head 61*d* for discharging an ink of each color as the second to the fifth ink to be used for the second image forming process are arranged as a group approximately at the center on the supporting member 22 so as to make longitudinal directions thereof in parallel with each other.

Further, on the supporting member 22 and at a downstream side in the conveyance direction X of the recording medium P with respect to a group of the color recording heads 61*a*, 61*b*, 61*c* and 61*d*, a background recording head 23 as the first recording head for discharging a white ink for a background as the first ink to be used for the first image forming process is arranged so as to make a longitudinal direction thereof approximately in parallel with that of the color recording heads 61*a*, 61*b*, 61*c* and 61*d*.

At the downstream side of the color recording heads 61*a*, 61*b*, 61*c* and 61*d* and the background recording head 23 in the conveyance direction X, ultraviolet irradiation devices 24*a* and 24*b* as ink curing sections for irradiating ultraviolet rays to cure and fix an ink are arranged respectively.

Further, the recording medium P is conveyed by a conveyance mechanism (now shown). This conveyance mechanism is capable of conveying the recording medium P in both the conveyance direction X and the reverse direction of the conveyance direction X.

Next, a control structure of the image recording device in the present embodiment will be described.

The image recording device comprises, as well as the image recording devices in the first embodiment, a controller for controlling each part of the image recording device, and information of a printing mode such as a front printing mode, a back printing mode or the like inputted at an input device (not shown) is transmitted to the controller.

Further, the controller makes each of the recording heads 61*a*, 61*b*, 61*c*, 61*d* and 23 serve so as to discharge an ink of each color. Further, the controller makes the ultraviolet irradiation devices 24*a* and 24*b* serve so as to irradiate ultraviolet rays to the ink discharged on the recording medium P.

Further, the controller controls the conveyance mechanism (not shown) so as to convey the recording medium P. The conveyance mechanism is capable of conveying the recording medium P in both the conveyance direction X and the reverse direction of the conveyance direction X, and thereby, according to need, the conveyance mechanism winds the recording medium P back in the reverse direction of the conveyance direction X.

Here, since the other structures are the same as the first embodiment, description thereof is omitted.

Next, operation of the present embodiment will be described.

When a front printing mode is selected at the input device, the controller makes the recording medium P conveyed up to a position corresponding to the background recording head 23, and turns on the ultraviolet irradiation device 24*a* located at the downstream side in the conveyance direction X of the recording medium P with respect to the background recording head 23. When the recording medium P is conveyed to the predetermined position, the controller makes the background recording head 23 serve so as to discharge a white ink for performing the first image forming process. Further, the ultraviolet irradiation device 24*a* located at the downstream side in the conveyance direction X with respect to the background recording head 23 irradiates ultraviolet rays to the white ink dropped on the recording medium P. Thereby, the white ink is cured so as to make a conversion of the ink not less than 50%.

Next, the controller makes the recording medium P conveyed in the reverse direction of the conveyance direction X up to a position corresponding to the color recording heads 61*a*, 61*b*, 61*c* and 61*d*. Further, the controller turns on the ultraviolet irradiation device 24*b* located at the downstream side in the conveyance direction X with respect to the color recording heads 61*a*, 61*b*, 61*c* and 61*d*. When the recording medium P is conveyed to the predetermined position, the controller makes the color recording heads 61*a*, 61*b*, 61*c* and 61*d* serve so as to discharge an ink of each color for performing the second image forming process. Further, the ultraviolet irradiation device 24*b* located at the downstream side in the conveyance direction X with respect to the color recording heads 61*a*, 61*b*, 61*c* and 61*d* irradiates ultraviolet rays to the ink of each color dropped on the recording medium P. Thereby, the color ink is cured and fixed. Here, at this time, the ultraviolet irradiation device 24*a* located at the downstream side in the conveyance direction with respect to the background recording head 23 may be kept turned on or be turned off.

Further, when a back printing mode is selected at the input device, the controller makes the recording medium P conveyed to a position corresponding to the color recording heads 61*a*, 61*b*, 61*c* and 61*d*, and turns on the ultraviolet irradiation device 24*b* located at the downstream side in the conveyance direction X with respect to the color recording heads 61*a*, 61*b*, 61*c* and 61*d* and the ultraviolet irradiation device 24*a* located at the downstream side in the conveyance direction with respect to the background recording head 23. When the recording medium P is conveyed to the predetermined position, the controller makes the color recording heads 61*a*, 61*b*, 61*c* and 61*d* serve so as to discharge an ink of each color for performing the second image forming process. Further, the ultraviolet irradiation device 24*b* located at the downstream side in the conveyance direction X with respect to the color recording heads 61*a*, 61*b*, 61*c* and 61*d* irradiates ultraviolet rays to the ink of each color dropped on the recording medium P. Thereby, the ink of each color is cured so as to make a conversion thereof not less than 50%.

The recording medium P is sequentially conveyed in the conveyance direction X, and when it is conveyed to a position corresponding to the background recording head 23, the background recording head 23 discharges a white ink for performing the first image forming process. Further, the ultraviolet irradiation device 24*a* located at the downstream side in the conveyance direction X with respect to the background recording head 23 irradiates ultraviolet rays to the white ink dropped on the recording medium P. Thereby, the white ink is cured and fixed. Here, at this time, the ultraviolet irradiation device 24*b* located at the downstream side in the conveyance direction X with respect to the color recording heads 61*a*, 61*b*, 61*c* and 61*d* may be kept turned on or be turned off.

As mentioned, by differentiating the timings of discharging ink by the background recording head 23 and the color recording heads 61*a*, 61*b*, 61*c* and 61*d*, from either white or color ink is discharged until the other ink is discharged, ultraviolet rays are irradiated to the ink. Thereby, curing and fixing are performed without mixing a white ink and a color ink. Consequently, it is possible to perform front printing and back printing with high definition achieved.

Therefore, in the present embodiment, by one image recording device, it is possible to perform both front printing and back printing with the number of background recording heads minimized.

Figure 6:
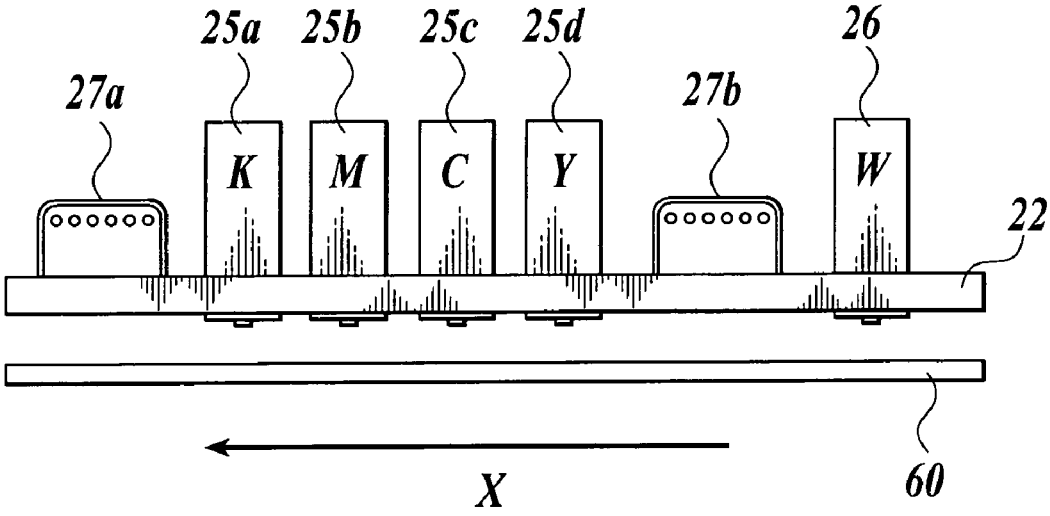
FIG. 6 is a pattern diagram showing one alternative arrangement of the ultraviolet irradiation devices, the color recording heads and the background recording heads of the image recording device in the second embodiment according to the present invention.

Here, in the present embodiment, the background recording head 23 is arranged at the downstream side in the conveyance direction with respect to a group of the color recording heads 61*a*, 61*b*, 61*c* and 61*d*. However, as shown in FIG. 6, color recording heads 25*a*, 25*b*, 25*c* and 25*d* may be arranged at a downstream side in a conveyance direction X with respect to a background recording head 26. In this case, when front printing is to be performed, an ink is discharged in the order of a white ink and a color ink while the recording medium P is sequentially conveyed in the conveyance direction X. Further, in the case of back printing where an ink of each color is discharged firstly, after the recording medium P is once conveyed to a position corresponding to the color recording heads 25*a*, 25*b*, 25*c* and 25*d*, the color recording heads 25*a*, 25*b*, 25*c* and 25*d* discharge an ink of each color. Then, after ultraviolet rays are irradiated to the ink of each color, the recording medium P is wound back in the reverse direction of the conveyance direction X, and then the background recording head 26 discharges a white ink. In other words, while the recording medium P is sequentially conveyed in the conveyance direction X, an ink is discharged in the order of a white ink and a color ink.

And so forth, as well as the first embodiment, the present invention is not limited to the present embodiment.

Next, with reference to FIGS. 7A and 7B, a third embodiment of an image recording device according to the present invention will be described. Here, only arrangement of recording heads and ultraviolet irradiation devices, control structures of conveyance mechanism of recording medium P, discharging ink and the timing of ultraviolet rays irradiation will be described since the others are the same as the first and second embodiments. Hereinafter, in particular, what is different from the first and second embodiments will be described.

Figure 7A:
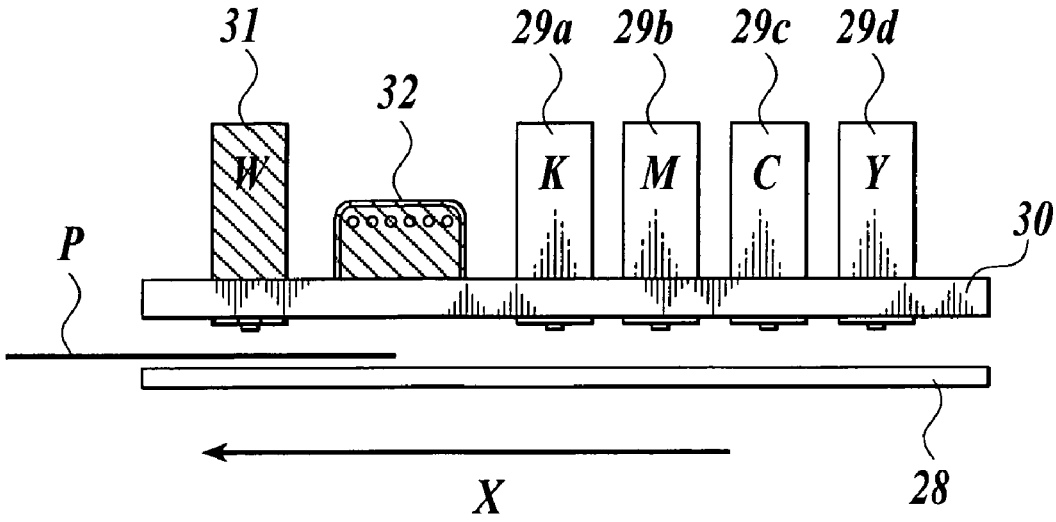
FIGS. 7A and 7B are pattern diagrams showing driving states of the ultraviolet irradiation device, the color recording heads and the background recording head of the image recording device in the third embodiment according to the present invention.
Figure 7B:
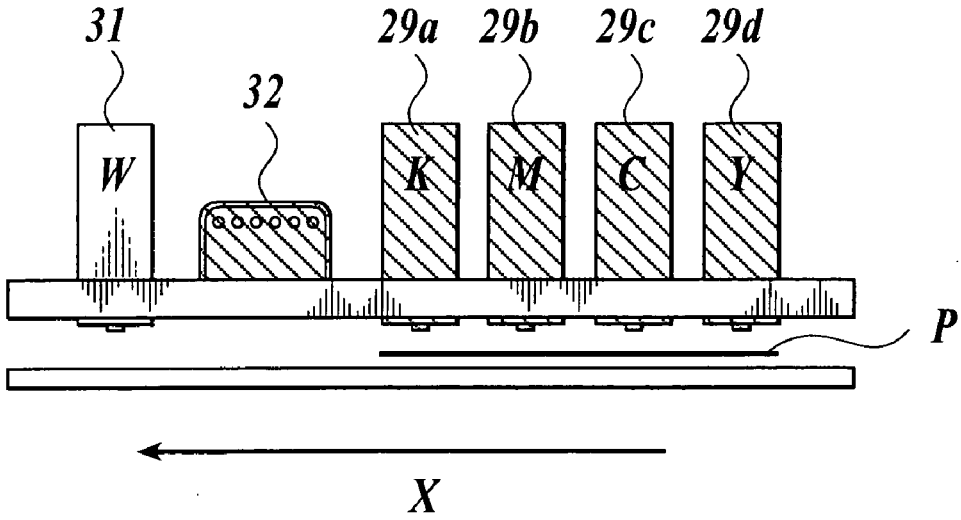

As shown in FIGS. 7A and 7B, in the present embodiment, above a platen 28, a second color recording head 29*a*, a third color recording head 29*b*, a fourth color recording head 29*c* and a fifth color recording head 29*d* as for discharging an ink of each color as the second to fifth ink to be used in the second image forming process are arranged as a group approximately at the center of a supporting member 30 so as to make longitudinal directions thereof in parallel with each other.

Further, on the supporting member 30 and at a downstream side in the conveyance direction X of the recording medium P with respect to a group of the color recording heads 29*a*, 29*b*, 29*c* and 29*d*, a background recording head 31 as the first recording head for discharging a white ink for a background as the first ink to be used in the first image forming process is arranged so as to be approximately in parallel with the longitudinal directions of the color recording heads 29*a*, 29*b*, 29*c* and 29*d*.

Further, between the color recording heads 29*a*, 29*b*, 29*c* and 29*d* and the background recording head 31, an ultraviolet irradiation device 32 as ink curing sections for irradiating ultraviolet rays to cure and fix an ink is arranged.

Further, the recording medium P is conveyed by a conveyance mechanism (not shown). This conveyance mechanism is capable of conveying the recording medium P in both the conveyance direction X and the reverse direction of the conveyance direction X.

Next, a control structure of the image recording device in the present embodiment will be described.

The image recording device comprises, as well as the image recording devices in the first and second embodiments, a controller (not shown) for controlling each part thereof. Information of a printing mode such as a front printing mode, a back printing mode or the like inputted at an input device (not shown) is transmitted to the controller.

Further, the controller makes each of the recording heads 29*a*, 29*b*, 29*c*, 29*d* and 31 serve so as to discharge an ink of each color for performing the first image forming process and the second image forming process. Further, the controller makes the ultraviolet irradiation device 32 serve so as to irradiate ultraviolet rays to the ink discharged on the recording medium P.

Further, the controller controls the conveyance mechanism (not shown) to convey the recording medium P. The conveyance mechanism is capable of conveying the recording medium P in both the conveyance direction X and the reverse direction of the conveyance direction X, and according to need, the conveyance mechanism winds the recording medium P back in the reverse direction of the conveyance direction X.

Here, since the other structures are the same as the first and second embodiments, description thereof is omitted.

Next, operation of the present embodiment will be described.

When a front printing mode is selected at the input device, the controller makes the recording medium P conveyed to a position corresponding to the background recording head 31, and turns on the ultraviolet irradiation device 32. When the recording medium P is conveyed to the predetermined position, the controller makes the background recording head 31 serve so as to discharge a white ink for performing the first image forming process. Next, the controller makes the ultraviolet irradiation device 32 irradiate ultraviolet rays to the white ink dropped on the recording medium P while making the recording medium P conveyed in the reverse direction of the conveyance direction X. Thereby, the white ink is cured so as to make a conversion thereof not less than 50%.

The controller further makes the recording medium P conveyed in the reverse direction of the conveyance direction X to a position corresponding to the color recording heads 29*a*, 29*b*, 29*c* and 29*d*. When the recording medium P is conveyed to the predetermined position, the controller makes the color recording heads 29*a*, 29*b*, 29*c* and 29*d* serve so as to discharge an ink of each color for performing the second image forming process. Next, the controller switches the conveyance direction X of the recording medium P, and makes the ultraviolet irradiation device 32 irradiate ultraviolet rays to the ink of each color dropped on the recording medium P while making the recording medium P conveyed in the conveyance direction X. Thereby, the ink of each color is cured and fixed.

Further, when a back printing mode is selected at the input device, the controller makes the recording medium P conveyed to a position corresponding to the color recording heads 29*a*, 29*b*, 29*c* and 29*d* and turns on the ultraviolet irradiation device 32. When the recording medium P is conveyed to the predetermined position, the controller makes the color recording heads 29*a*, 29*b*, 29*c* and 29*d* serve so as to discharge an ink of each color for performing the second image forming process. Further, the ultraviolet irradiation device 32 irradiates ultraviolet rays to the ink of each color dropped on the recording medium P. Thereby, the ink of each color is cured so as to make a conversion thereof not less than 50%.

When the recording medium P is sequentially conveyed in the conveyance direction X to a position corresponding to the background recording head 31, the background recording head 31 discharges a white ink for performing the first image forming process. Next, the controller switches the conveyance direction X of the recording medium P, and makes the ultraviolet irradiation device 32 irradiate ultraviolet rays to the white ink dropped on the recording medium P while making the recording medium P conveyed in the reverse direction of the conveyance direction X. Thereby, the white ink is cured and fixed.

As mentioned, by differentiating the timings of discharging ink by the background recording head 31 and the color recording heads 29*a*, 29*b*, 29*c* and 29*d*, from either a white or color ink is discharged until the other ink is discharged, ultraviolet rays are irradiated to the ink. Thereby, curing and fixing are performed without mixing a white ink and a color ink. Consequently, it is possible to perform front printing and back printing with high definition achieved.

Therefore, in the present embodiment, it is possible to perform both front printing and back printing with the number of the background recording head 31 and the ultraviolet irradiation device 32 minimized.

Figure 8:
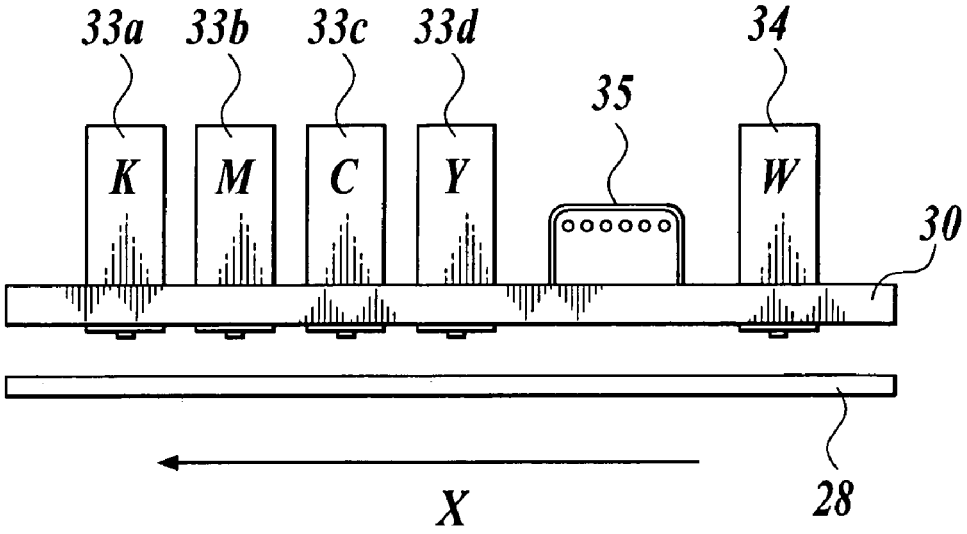
FIG. 8 is a pattern diagram showing one alternative arrangement of the ultraviolet irradiation device, the color recording heads and the background recording head of the image recording device in the third embodiment according to the present invention.

Here, in the present embodiment, the background recording head 31 is arranged at the downstream side in the conveyance direction X with respect to a group of the color recording heads 29*a*, 29*b*, 29 and 29*d*. However, as shown in FIG. 8, color recording heads 33*a*, 33*b*, 33*c* and 33*d* may be arranged at a downstream side in the conveyance direction X with respect to a background recording head 34. In this case, when front printing is to be performed, an ink is discharged in the order of a white ink and a color ink while the recording medium P is sequentially conveyed in the conveyance direction X. Then, after the color ink is discharged, the conveyance direction X of the recording medium P is switched and an ultraviolet irradiation device 35 irradiates ultraviolet rays to the color ink dropped on the recording medium P while the recording medium P is conveyed in the reverse direction of the conveyance direction X. Further, in the case of back printing where an ink of each color is discharged firstly, after the recording medium P is once conveyed to a position corresponding to the color recording heads 33*a*, 33*b*, 33*c* and 33*d*, the color recording heads 33*a*, 33*b*, 33*c* and 33*d* discharge an ink of each color. Then, after ultraviolet rays are irradiated to the ink of each color while the recording medium P is wound back in the reverse direction of the conveyance direction X, the background recording head 34 discharges a white ink. Thereafter, the ultraviolet irradiation device 24 irradiates ultraviolet rays while the recording medium P is re-conveyed in the conveyance direction X. Thereby, the white ink is cured and fixed.

Further, in the present embodiment, the explanation is made with the example that the recording medium P moves back and forth over the same plain surface as the platen in order to complete the first image forming process and the second image forming process. However, the present invention is not limited to the mentioned example. For example, if the recording medium P has a cut-sheet-like shape, instead of the back-and-forth movement over the same plain surface as mentioned, a structure where a conveyance path is provided for re-conveying the recording medium P after the first image forming process is completed without inverting a recording surface of the recording medium P, and the recording medium P is re-conveyed to the platen through the conveyance path for performing the second image forming process, is acceptable.

Figure 9:
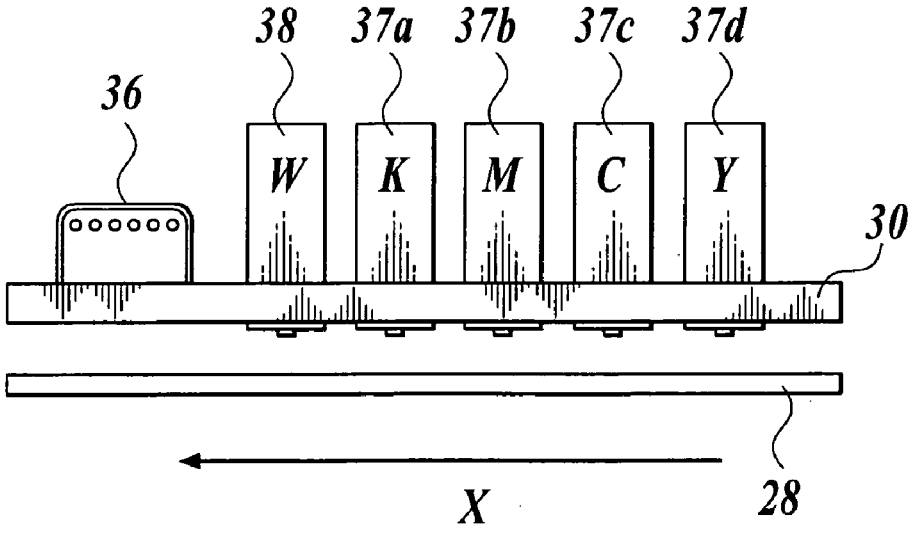
FIG. 9 is a pattern diagram showing one alternative arrangement of the ultraviolet irradiation device, the color recording heads and the background recording head of the image recording device in the third embodiment according to the present invention.

Further, as shown in FIG. 9, an ultraviolet irradiation device 36 may be arranged at a downstream side in the conveyance direction X with respect to color recording heads 37*a*, 37*b*, 37 and 37*d* and a background recording head 38. In this case, when front printing where a white ink is discharged firstly is to be performed, after the recording medium P is once conveyed to a position corresponding to the background recording head 38, the background recording head 38 discharges a white ink, and then the ultraviolet irradiation device 36 irradiates ultraviolet rays to the white ink dropped on the recording medium P. Next, the conveyance direction X of the recording medium P is switched, and the recording medium P is conveyed to a position corresponding to the color recording heads 37*a*, 37*b*, 37*c* and 37*d*. Then, after the color recording heads 37*a*, 37*b*, 37*c* and 37*d* discharge an ink of each color, ultraviolet rays are irradiated to the ink of each color while the recording medium P is re-conveyed in the conveyance direction X. Further, arrangement of the color recording heads 37*a*, 37*b*, 37*c* and 37*d*, the background recording head 38 and the ultraviolet irradiation device 36 is not limited to the description above. For example, the arrangement may be made in the order of the background recording head, the color recording head and the ultraviolet irradiation device, from the upstream side in the conveyance direction. In this case, according to a printing mode such as a front printing mode or a back printing mode, by switching the conveyance direction X of the recording medium P, a white ink and an ink of each color are sequentially discharged and suitably ultraviolet rays are irradiated so as to make each ink cured and fixed.

And so forth, as well as the first and second embodiments, the present invention is not limited to the present embodiment.

Next, with reference to FIG. 10, a fourth embodiment of an image recording device according to the present invention will be described. Here, only arrangement of recording heads and ultraviolet irradiation devices, control structures of conveyance mechanism of recording medium P, discharging ink and the timing of ultraviolet rays irradiation will be described since the others are the same as the first, second and third embodiments. Hereinafter, in particular, what is different from the first, second and third embodiments will be described.

Figure 10:
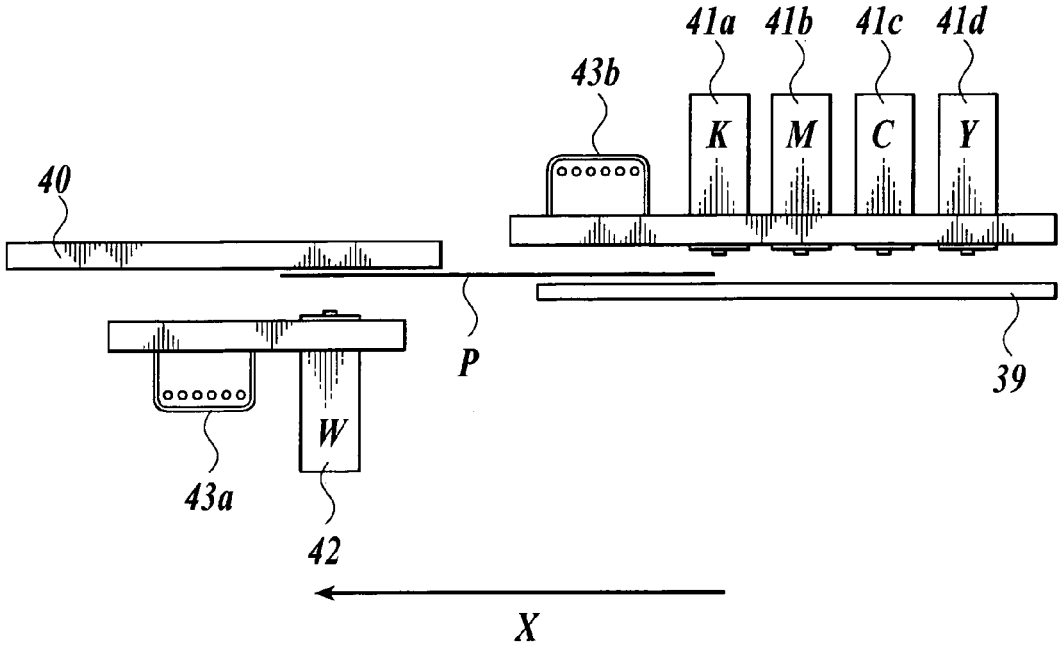
FIG. 10 is a pattern diagram showing one alternative arrangement of the ultraviolet irradiation devices, the color recording heads and the background recording head of the image recording device in the fourth embodiment according to the present invention.

As shown in FIG. 10, in the present embodiment, in the image recording device, a first platen 39 is provided so as to support the recording medium P from the back side. Further, at a downstream side in the conveyance direction X of the recording medium P with respect to the first platen 39, a second platen 40 is provided so as to support the recording medium P from the front side. The first platen 39 and the second platen 40 support the recording medium P with the use of means such as electrostatic absorption or the like.

In regard to both the platen 39 and 40, at a position facing the first platen 39 provided at the back side of the recording medium P with respect to the recording medium P, a second color recording head 41*a*, a third color recoding head 41*b*, a fourth color recording head 41*c* and a fifth color recoding head 41*d* for discharging an ink of each color as the second to fifth ink to be used in the second image forming process are arranged so as to make longitudinal directions thereof in parallel with each other. Further, at a position facing the second platen 40 provided at the front side of the recording medium P with respect to the recording medium P, a background recording head 42 as the first recording head for discharging a white ink for a background as the first ink to be used in the first image forming process is arranged.

At a downstream side in the conveyance direction X of the recording medium P with respect to each of the color recording heads 41*a*, 41*b*, 41*c* and 41*c* and the background recording head 42, ultraviolet irradiation devices 43*a* and 43*b* as ink curing sections for irradiating ultraviolet rays in order to cure and fix an ink are arranged.

Further, the image recording device comprises a conveyance mechanism (not shown), and the conveyance mechanism conveys the recording medium P in the predetermined conveyance direction X.

Here, the recording medium P used in the present embodiment is transparent or semi-transparent resin film or the like, and it is possible to perform the image recording on both the sides.

Next, a control structure of the image recording device in the present embodiment will be described.

The image recording device comprises, as well as the image recording devices in the first, second and third embodiments, a controller (not shown) for controlling each part of the image recording device. Information of a printing mode such as a single side printing, a duplex printing and the like inputted at an input device (not shown) is transmitted to the controller.

Further, the controller makes each of the recording heads 41*a*, 41*b*, 41*c*, 41*d* and 42 serve so as to discharge an ink of each color for performing the first image forming process and the second image forming process. Further, the controller makes the ultraviolet irradiation devices 43*a* and 43*b* serve so as to irradiate ultraviolet rays to the ink discharged on the recording medium P.

Further, the controller controls the conveyance mechanism (not shown) so as to convey the recording medium P.

Here, since the other structures are the same as the first, second and third embodiments, description thereof is omitted.

Next, operation of the present embodiment will be described.

When a duplex printing with the use of a color ink and a white ink is selected, the recording medium P is conveyed on the first platen 39, and then color recording heads 41*a*, 41*b*, 41*c* and 41*d* discharge an ink of each color and the ink is dropped on the surface of the recording medium P for performing the second image forming process. Thereafter, the ultraviolet irradiation device 43*b* located at a downstream side in the conveyance direction X with respect to the color recording heads 41*a*, 41*b*, 41*c* and 41*d* irradiates ultraviolet rays to the ink dropped on the recording medium P for curing and fixing the color ink. Further, the recording medium P is conveyed along the conveyance direction X on the second platen 40, and the background recoding head 42 discharges a white ink to be dropped on the back side of the recording medium P for performing the first image forming process. Thereafter, the ultraviolet irradiation device 43*a* located at a downstream side in the conveyance direction X with respect to the background recording head 42 irradiates ultraviolet rays to the white ink dropped on the recording medium P for curing and fixing the white ink. Thereby, a predetermined image is recorded on the recording medium P. On the other hand, when a single-side printing with the use of only a color ink is selected, after the color recording heads 41*a*, 41*b*, 41*c* and 41*d* discharge an ink of each color for performing the second image forming process, the ultraviolet irradiation device 43*b* located at a downstream side in the conveyance direction with respect to the color recording heads 41*a*, 41*b*, 41*c* and 41*d* irradiates ultraviolet rays to the ink dropped on the recording medium P. Thereby, the color ink is cured and fixed, and then a predetermined image is recorded.

As mentioned, by differentiate a surface of the recording medium P to which the background recording head 42 discharges an ink and a surface to which the color recording heads 41*a*, 41*b*, 41*c* and 41*d* discharge an ink, the image recording by the background recording head 42 and the image recording by the color recording heads 41*a*, 41*b*, 41*c* and 41*d* are spatially separated. Thereby, a white ink and a color ink are cured and fixed without mixing each other, and consequently, it is possible to perform front printing and back printing with high resolution achieved.

Further, in the case of having such a structure, it is possible to control both the image forming processes without paying attention to a conversion of the ink in the first image forming process and a start timing of the second image forming process.

Therefore, in the present embodiment, by using one image recording device so as to discharge a color ink and a white ink on the front side and the back side of the recording medium P respectively, it is possible to easily perform a duplex printing on a transparent or semi-transparent recording medium P.

Here, in the present embodiment, the color recording heads 41*a*, 41*b*, 41*c* and 41*d* are arranged so as to face the first platen 39 provided at the back side of the recording medium P, and the background recording head 42 is arranged so as to face the second platen 40 provided at the front side of the recording medium P. However, the background recording head may be arranged so as to face the first platen provided at the back side of the recording medium P, and the color recording head may be arranged so as to face the second platen provided at the front side of the recording medium P.

Further, the image recording may be performed from both the front side and the back side of the recording medium P in a state where the recording medium P is conveyed in a perpendicular direction to a floor plane, and the color recording head and the background recording head are arranged on the front side and the back side of the recording medium respectively.

Further, if the recording medium P has a roll-like shape or the like, for example, by providing a roller or the like for supporting the recording medium P at either an upstream side or a downstream side in the conveyance direction with respect to an area for the image recording, and then extending the recording medium P over the roller or the like, it is possible to perform the image recording without a platen provided. In this case, it is possible to provide the color recording head and the background recording head on the front side and the back side of the recording medium P so as to face each other. In accordance with such a structure, it is possible to simultaneously perform the image recording operation with a color ink and a white ink on the front side and the back side of the recording medium P. Thereby, it is possible to have the image recording device with speedup achieved.

And so forth, as well as the first, second and third embodiments, the present invention is not limited to the present embodiment.

Next, with reference to FIG. 11, a fifth embodiment of an image recording device according to the present invention will be described. Here, in the present embodiment, only arrangement of the recording heads and ultraviolet irradiation devices, control structures of conveyance mechanism of recording medium, discharging ink and the timing of ultraviolet rays irradiation will be described since the others are the same as the first, second, third and fourth embodiments. Hereinafter, in particular, what is different from the first, second, third and fourth embodiments will be described.

Figure 11:
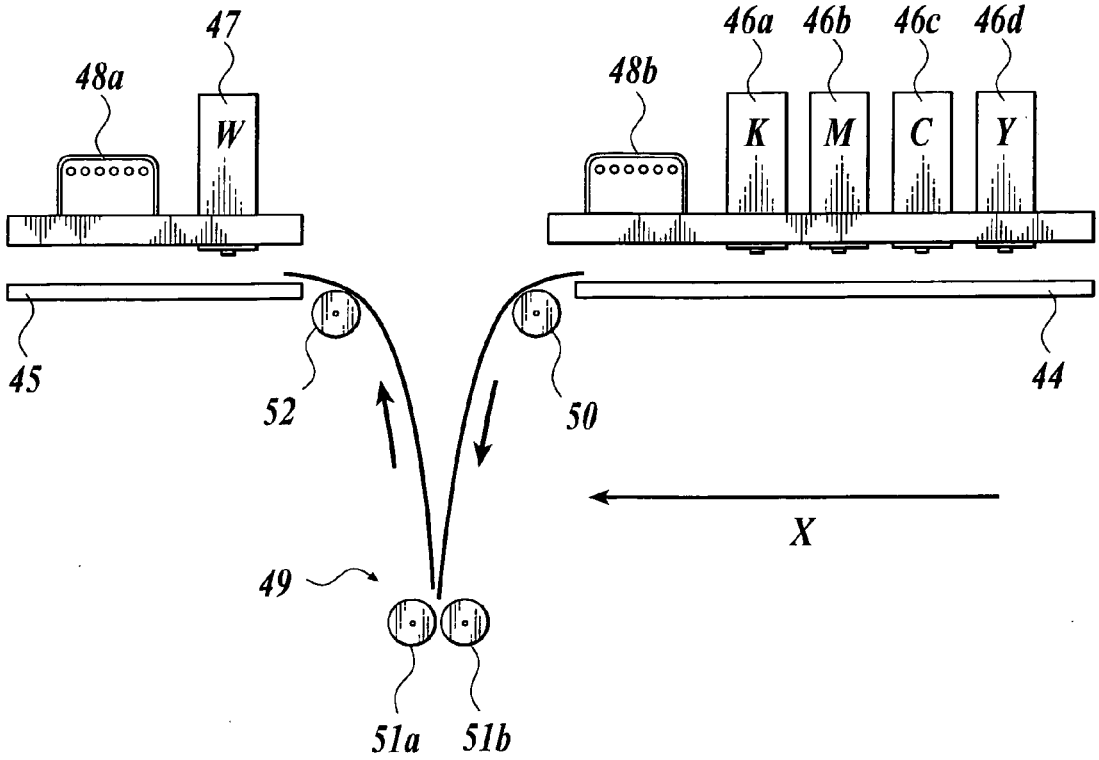
FIG. 11 is a pattern diagram showing one alternative arrangement of the ultraviolet irradiation devices, the color recording heads and the background recording head of the image recording device in the fifth embodiment according to the present invention.

As shown in FIG. 11, in the present embodiment, in the image recording device, a first platen 44 is provided so as to support the recording medium P from its back side. Further, a second platen 45 is provided at a downstream side in the conveyance direction X with respect to the first platen 44 so as to support the recording medium P from its back side. The first platen 44 and the second platen 45 support the recording medium P with the use of means such as electrostatic absorption.

In regard to both the platen 44 and 45, at a position facing the first platen 44 with respect to the recording medium P, a second color recording head 46*a*, a third color recording head 46*b*, a fourth color recording head 46*c* and a fifth color recording head 46*d* for discharging an ink of each color as the second to fifth ink to be used in the second image forming process are arranged so as to make longitudinal directions thereof in parallel with each other. Further, at a position facing the second platen 45 with respect to the recording medium P, a background recording head 47 as the first recording head for discharging a white ink of background as the first ink to be used in the first image forming process is arranged.

At a downstream side in the conveyance direction with respect to each of the color recording heads 46*a*, 46*b*, 46*c* and 46*d* and the background recording head 47, provided are ultraviolet irradiation devices 48*a* and 48*b* as ink curing sections for irradiating ultraviolet rays in order to cure and fix an ink.

As shown in FIG. 11, between the first platen 44 and the second platen 45, provided is a switch back mechanism 49 as inversing mechanism for inversing the front side and back side of the recording medium P. After passing above the first platen 44, the recording medium P is guided to the switch back mechanism 49 by making an approximately orthogonal turn toward the lower part of the image recording device 1. The switch back mechanism 49 comprises a pair of switching rollers 51*a* and 51*b* which are driven to rotate by a driving mechanism (not shown). The switching rollers 51*a* and 51*b* are capable of switching their rotation direction suitably, and once convey the recording medium P in a downward direction of the image recording device 1 and then re-convey the recording medium P in an upward direction of the image recording device with the conveyance direction X of the recording medium P switched into the opposite direction. At an upstream side in the conveyance direction X with respect to the second platen 45, provided is a second guide roller 52 for leading the recording medium P which is conveyed by the switching rollers 51*a* and 51*b* of the switch back mechanism 49 on the second platen 44.

Further, the image recording device 1 comprises a conveyance mechanism (not shown), and the conveyance mechanism conveys the recording medium P in a predetermined conveyance direction X.

Here, the recording medium P used in the present embodiment is transparent or semi-transparent resin film or the like, and various forms such as a cut-sheet-like form which is the recording medium cut into a certain size, plate-like form and the like can be applied to the recording medium P.

Next, a control structure of the image recording device in the present embodiment will be described.

The image recording device in the present embodiment comprises, as well as the image recording devices in the first, second, third and fourth embodiments, a controller (not shown) for controlling each part of the image recording device, and information of a printing mode such as a single side printing, a duplex printing or the like inputted at an input device is transmitted to the controller.

Further, the controller controls each of the recording heads 46*a*, 46*b*, 46*c*, 46*d* and 47 so as to discharge an ink of each color for performing the first image forming process and the second image forming process. Further, the controller controls the ultraviolet irradiation devices 48*a* and 48*b* so as to irradiate ultraviolet rays to the ink discharged on the recording medium P.

Further, the controller controls the conveyance mechanism (not shown) so as to convey the recording medium P.

Further, the controller controls the switching rollers 51*a* and 51*b* of the switch back mechanism 49 so as to inverse the front side and back side of the recording medium P.

Here, since the other structures are the same as the first, second, third and fourth embodiments, description thereof is omitted.

Next, operation of the present embodiment will be described.

When a duplex printing with the use of a color ink and a white ink is selected, the recording medium P is conveyed on the first platen 44, and then the color recording heads 46*a*, 46*b*, 46*c* and 46*d* discharge an ink of each color to be dropped on the front side of the recording medium P for performing the second image forming process. Thereafter, the ultraviolet irradiation device 48*b* located at a downstream side in the conveyance direction X with respect to the color recoding heads 46*a*, 46*b*, 46*c* and 46*d* irradiates ultraviolet rays to the ink dropped on the recording medium P for curing and fixing the color ink. Then, the recoding medium P is conveyed to the switch back mechanism 49 with the guide by the first guide roller 50, and is once conveyed in the downward direction by the switching rollers 51*a* and 51*b*. Thereafter, according to the switching rollers 51*a* and 51*b* rotating in the reverse direction, the recording medium P is re-conveyed in the upward direction and guided on the second platen 45 with the back side thereof inversed so as to be faced up. Then, the background recording head 47 discharges a white ink to the recording medium P conveyed on the second platen 45 to be dropped on the back side of the recording medium P for performing the first image forming process. Thereafter, the ultraviolet irradiation device 48 located at a downstream side in the conveyance direction X with respect to the background recording head 47 irradiates ultraviolet rays to the white ink dropped on the recording medium P for curing and fixing the white ink. Thereby, a predetermined image is recorded on the recording medium P. On the other hand, when a single-side printing with the use of only a color ink, the color recording heads 46*a*, 46*b*, 46*c* and 46*d* discharge an ink of each color for performing the second image forming process, and the ultraviolet irradiation device 48*b* located at the downstream side in the conveyance direction X with respect to the color recording heads 46*a*, 46*b*, 46*c* and 46*d* irradiates ultraviolet rays to the ink dropped on the recording medium P for curing and fixing the color ink. Thereby, a predetermined image is recorded.

As mentioned, by differentiating a position to which the background recording head 47 discharges an ink and a position to which the color recording heads 46*a*, 46*b*, 46*c* and 46*d* discharge an ink, the image recording by the background recording head 47 and the image recording by the color recording heads 46*a*, 46*b*, 46*c* and 46*d* are spatially separated. Thereby, a white ink and a color ink are cured and fixed without mixing each other, and consequently, it is possible to perform front printing and back printing with high resolution achieved.

Therefore, in the present embodiment, by making one image recording device discharge a color ink and a white ink on the front side and the back side of the recording medium P respectively, it is possible to easily perform a duplex printing on a transparent or semi-transparent recording medium P.

Here, in the present embodiment, the color recording heads 46*a*, 46*b*, 46*c* and 46*d* are provided so as to face the first platen 44, and the background recording head 47 is provided so as to face the second platen 45. However, the background recording head may be provided so as to face the first platen, and the color recording head may be provided so as to face the second platen.

Further, a mechanism to inverse the front side and the back side of the recording medium P is not limited to what is shown in the present embodiment, and other types of mechanism can be applied to the mechanism.

And so forth, as well as the first, second, third and fourth embodiments, the present invention is not limited to the present embodiment.

According to the present invention, in the case of an image recording device with a line print system, by differentiate timings or positions of image recording by a color recording head and that of image recording by a background recording head, it is possible to perform front printing, back printing and duplex printing with the use of an ink for a background with one device without making the device larger and with a simple structure.

Further, since a step of image recording by the background recording head and a step of image recording by the color recording head are performed separately, it is possible to perform image recording with high definition achieved without mixing a background ink such as white or the like and a color ink.

In addition, since the background recording head is located at either an upstream side or a downstream side in the conveyance direction of the recording medium with respect to the color recording head, in an image recording device with a line print system, it is possible to perform both front printing and back printing with the use of a background ink with one device.

In addition, when a background ink to be printed as a background color such as white is mixed with a color ink on the recording medium, unlike the case that color inks are mixed with each other, blurring and washing out of an image may occur, and thereby there is a possibility of decreasing printing quality. Therefore, it is necessary to irradiate ultraviolet rays as soon as the background ink is dropped on the recording medium for completely curing and fixing the ink. In view of this, by providing ink curing sections between the background recording head and other recording head, it is possible to cure and fix an ink immediately after the ink is dropped. Thereby, it is possible to prevent the image quality decrease such as image blurring or the like due to mixing a background ink and a color ink.

In addition, in the case of an image recording device with a line print system, by suitably switching a conveyance direction of the recording medium, it is possible to perform both front printing and back printing with the use of a background ink with one device without providing a plurality of background recording heads and ink curing sections.

In addition, in the case of an image recording device with a line print system, it is possible to rapidly perform a duplex printing with the use of a background ink without making the device larger, with one device and with a simple structure.

In addition, since a white ink is used as a background ink, in the case of performing front printing and back printing, it is possible to make an image printed by a color ink stand out more clearly.

In addition, since the background printing is performed with high shielding characteristic, in the case of performing front printing and back printing, it is possible to make an image printed by a color ink stand out more clearly.

In addition, the background recording head is capable of printing a background with high shielding characteristic by jetting more ink than other recording head. Here, since, it is possible to control each recording head in an image recording device with a line print system unlike an image recording device with a serial print system, it is possible to make ink discharging amount from the background recording head larger than that from the color recording head. Thereby, it is possible to perform the background printing without decreasing image recording speed. Consequently, it is possible to print the background with high shielding characteristic in a short time period, and thereby productivity can be improved.

In addition, ink amount discharged from nozzles are adjusted so as to make a dot diameter of an ink discharged from a background recording head not less than 140% with respect to a nozzle interval of the background recording head. Unlike a color ink to be used for printing letters and images, in regard to a background ink, it is not necessary to perform the image recording with high resolution by discharging a small-size ink. Therefore, it is possible to make the dot diameter large by increasing ink discharging amount as mentioned, and thereby it is possible to perform the background printing evenly with a short time period.

In addition, even in the case of performing front printing and back printing with the use of an ink having a characteristic of being cured by light irradiation, it is possible to perform high quality printing without image blurring occurring due to mixing a background ink and a color ink.

In addition, since it is possible to perform front printing and back printing on a transparent or semi-transparent recording medium, even in the case of a soft packaging medium, it is possible to form a high quality image.

In addition, even in the case of discharging an ink of different colors on the same plane of the recording. medium, since the first ink and the second ink are not mixed on the recording medium, it is possible to record a high quality image.

In addition, in at least a part of an arbitrary area in the same plane of the recording medium, the first image forming process and the second image forming process are overlapped. Therefore, at the overlapped part, one image recording stands out with respect to the other image recording, and durability of a recorded image improves due to the overlap.

In addition, it is possible to make the image recording by a color ink stand out by performing the image recording with a background ink, and to improve durability of an image recorded by overlapping the background ink on the image recording by the color ink.

In addition, it is possible to perform both an image forming process for a color purpose and an image forming process for a background purpose with one image recording device.

In addition, by performing the image recording on an entire arbitrary area of the recording medium, it is possible to form a high quality image with high durability.

In addition, since one of the first recording head and the second recording head has a plurality of recording heads for discharging an ink of different colors, it is possible to perform the image recording with high resolution achieved by the ink of a plurality of colors.

In addition, the curing section is used for both the first image forming process and the second image forming process, even if both the processes are to be performed, it is not necessary to have plural curing sections, and thereby a simple, light device structure can be achieved.

In addition, by providing the curing section for the first image forming process and the second image forming process respectively, it is possible to securely cure the ink discharged in each image forming process, and thereby it is possible to perform the image recording with high resolution achieved.

In addition, even in the case that a plurality of recording heads are provided corresponding to an ink of a plurality of colors, it is possible to cure the ink by the curing section provided corresponding to each recording head immediately after each recording head discharges the ink. Therefore, since the ink is not mixed on the recording medium even in the case of sequentially performing the image recording, it is possible to perform the image recording with high resolution achieved always.

In addition, in the case of an image recording device with a line print system, it is possible to perform front printing, back printing and duplex printing with the use of a background ink easily and rapidly.

In addition, by irradiating ultraviolet rays to an ink dropped on the recording medium so as to cure and fix the ink, it is possible to form an image with high resolution achieved.

In addition, by making a moving section move either the recording medium, or the recording head and the curing section, it is possible to effectively cure and fix an ink discharged and dropped from the recording head.

In addition, since it is possible to perform the image recording on a transparent or semi-transparent recording medium from both the sides, it is possible to perform the image recording on a soft packaging medium with high resolution achieved and with colors standing out.

The entire disclosure of Japanese Patent Application Nos. Tokugan 2003-088685 filed on Mar. 27, 2003 and Tokugan 2004-047641 filed on Feb. 24, 2004 including specifications, claims, drawings and summaries are incorporated herein by reference in their entirety.

What is claimed is:

1. An image recording device, comprising:

a first recording head which discharges a first ink for a first image forming process, wherein the first ink is an ultraviolet-ray curable ink, which is cured as irradiated with ultraviolet rays;

a second recording head which discharges a second ink for a second image forming process, wherein the second ink is an ultraviolet-ray curable ink, which is cured as irradiated with ultraviolet rays;

a curing section which cures the ultraviolet-ray curable ink on a recording medium, wherein the curing section includes an ultraviolet light source generating the ultraviolet rays to cure the ultraviolet ray curable ink; and a controller which controls the curing section to cure the first ink on the recording medium, and controls the second recording head to start discharging the second ink after a conversion of the first ink on the recording medium becomes not less than 30%, wherein the second image forming process is a process for a background, and a layer of the second ink has a transmission density not less than 0.15 or an L value not less than 65.

2. The image recording device of claim 1, wherein the controller controls at least one of the first recording head and the second recording head so as to overlap at least a part of a first recording area of the first image forming process and a part of a second recording area of the second image forming process in an arbitrary area on a recording surface of the recording medium.

3. The image recording device of claim 1, wherein a color of the second ink is white.

4. The image recording device of claim 1, wherein the controller controls either the first recording head or the second recording head so as to record in all of an arbitrary area of the recording medium.

5. The image recording device of claim 1, wherein the first recording head and the second recording head include a plurality of nozzles for an ink discharge, and a diameter of ink at the 100% conversion of the ink is not less than 140% of a distance between centers of adjacent nozzles of the first recording head or the second recording head.

6. The image recording device of claim 5, wherein the curing section includes a plurality of cure devices corresponding to each recording head.

7. The image recording device of claim 1, comprising:

a third recording head which discharges a third ink for the first image forming process;

a fourth recording head which discharges a fourth ink for same process of the third recording head; and a fifth recording head which discharges a fifth ink for same process of the third recording head.

8. The image recording device of claim 1, wherein the curing section cures the first ink and the second ink on the recording medium.

9. The image recording device of claim 1, wherein the curing section includes a first cure device for the first image forming process and a second cure device for the second image forming process.

10. The image recording device of claim 1, wherein the first recording head and the second recording head are extending in a width direction of the recording medium.

11. The image recording device of claim 1, comprising:

a moving section which relatively moves the recording medium to the first and second recording head and/or the curing section.

12. The image recording device of claim 1, wherein a layer of the second ink has a transmission density not less than 0.2 or an L value of not less than 70.

13. The image recording device of claim 12, wherein a layer of the second ink has a transmission density not more than 0.5 or an L value not more than 100.

14. An image recording device, comprising:

a first recording head which discharges a first ink for first image forming process, wherein the first ink is an ultraviolet-ray curable ink, which is cured as irradiated with ultraviolet rays;

a second recording head which discharges a second ink for a second image forming process, wherein the second ink is an ultraviolet-ray curable ink, which is cured as irradiated with ultraviolet rays;

a curing section which cures the ultraviolet-ray curable ink on a recording medium, wherein the curing section includes an ultraviolet light source generating the ultraviolet rays to cure the ultraviolet-ray curable ink; and a controller which controls the curing section to cure the first ink on the recording medium, and controls the second recording head to start discharging the second ink after a conversion of the first ink on the recording medium becomes not less than 30%, wherein the first image forming process is a process for background, and a layer of the first ink has a transmission density not less than 0.16 or an L value not less than 65.

15. The image recording device of claim 14, wherein the controller controls at least one of the first recording head and the second recording head so as to overlap at least a part of a first recording area of the first image forming process and a part of a second recording are of the second image forming process in an arbitrary area on a recording surface of the recording medium.

16. The image recording device of claim 14, wherein the color of the first ink is white.

17. The image recording device of claim 14, wherein the controller controls either the first recording head or the second recording head so as to record in all of an arbitrary area of the recording medium.

18. The image recording device of claim 14, wherein the first recording head and the second recording head include a plurality of nozzles for an ink discharge, and a diameter of ink at the 100% conversion of the ink is not less than 140% of the distance between centers of adjacent nozzles of the first recording head or the second recording head.

19. The image recording device of claim 14, comprising:

a third recording head which discharges a third ink for the second image forming process;

a fourth recording head which discharges a fourth ink for the same process of the third recording head; and a fifth recording head which discharges a fifth ink for the same process of the third recording head.

20. The image recording device of claim 19, wherein the curing section includes plurality of cure devices corresponding to each recording head.

21. The image recording device of claim 14, wherein the curing section cures the first ink and the second ink on the recording medium.

22. The image recording device of claim 14, wherein the curing section includes a first cure device for the first image forming process and a second cure device for the second image forming process.

23. The image recording device of claim 14, wherein the first recording head and the second recording head extend in a width direction of the recording medium.

24. The image recording device of claim 14, wherein a layer of the first ink has a transmission density not less than 0.2 or an I value not less than 70.

25. The image recording device of claim 24, wherein the layer of the first ink has a transmission density not more than 0.5 or an L value not more than 100.

* * * * *